United States Patent [19]

Matsuo et al.

[11] Patent Number: 4,905,053

[45] Date of Patent: Feb. 27, 1990

[54] SHEET RE-FEEDING APPARATUS PROVIDED FOR IMAGE FORMING APPARATUS

[75] Inventors: Hirokazu Matsuo; Hiroyasu Nagato, both of Osaka, Japan

[73] Assignee: Minolta Camera Kabushiki Kaisha, Osaka, Japan

[21] Appl. No.: 148,698

[22] Filed: Jan. 26, 1988

[30] Foreign Application Priority Data

| | | | |
|---|---|---|---|
| Jan. 28, 1987 | [JP] | Japan | 62-17771 |
| Jan. 28, 1987 | [JP] | Japan | 62-17772 |
| Jan. 28, 1987 | [JP] | Japan | 62-17773 |
| Jan. 28, 1987 | [JP] | Japan | 62-17774 |
| Jan. 28, 1987 | [JP] | Japan | 62-17775 |
| Jan. 28, 1987 | [JP] | Japan | 62-17776 |
| Jan. 28, 1987 | [JP] | Japan | 62-17777 |
| Jan. 28, 1987 | [JP] | Japan | 62-17778 |
| Jan. 28, 1987 | [JP] | Japan | 62-17779 |

[51] Int. Cl.[4] ..... G03G 15/00; G03G 15/00

[52] U.S. Cl. ..... 355/319; 355/311; 355/321; 271/3.1

[58] Field of Search ..... 355/3 SH, 14 SH, 23, 355/24, 26; 271/3.1

[56] References Cited

U.S. PATENT DOCUMENTS

| | | | |
|---|---|---|---|
| 3,386,729 | 6/1968 | Pine . | |
| 3,645,615 | 2/1972 | Spear, Jr. | 355/3 R |
| 3,697,063 | 1/1972 | Greenfield et al. . | |
| 3,709,595 | 1/1973 | Turner et al. . | |
| 3,944,207 | 3/1976 | Bains . | |
| 4,067,649 | 1/1978 | Hubbard et al. . | |
| 4,073,391 | 2/1978 | O'Brien et al. . | |
| 4,076,408 | 2/1978 | Reid et al. . | |
| 4,123,155 | 10/1978 | Hubert . | |
| 4,134,672 | 1/1979 | Burlew et al. . | |
| 4,145,037 | 3/1979 | Mol . | |
| 4,190,246 | 2/1980 | Sasuga . | |
| 4,203,587 | 5/1980 | Kishi et al. . | |
| 4,218,128 | 8/1980 | Satomi et al. | 355/26 X |
| 4,227,275 | 10/1980 | Söderberg . | |
| 4,238,066 | 12/1980 | Brooke . | |
| 4,248,413 | 2/1981 | Fox . | |
| 4,248,525 | 2/1981 | Sterrett . | |
| 4,265,440 | 5/1981 | Shibazaki et al. . | |

(List continued on next page.)

FOREIGN PATENT DOCUMENTS

| | | |
|---|---|---|
| 99250 | 1/1984 | European Pat. Off. . |
| 2732673 | 9/1978 | Fed. Rep. of Germany . |
| 57-72537 | 5/1982 | Japan . |
| 57-131667 | 11/1982 | Japan . |
| 60-183461 | 10/1985 | Japan . |
| 61-261096 | 4/1986 | Japan . |
| 61-145069 | 7/1986 | Japan . |
| 2185465 | 7/1987 | United Kingdom . |

*Primary Examiner*—R. L. Moses

*Attorney, Agent, or Firm*—Burns, Doane, Swecker & Mathis

[57] ABSTRACT

In order to execute the duplex copying operation, a sheet re-feeding apparatus transports sheets having an image formed with an image-forming apparatus one by one into a cassette through a transporting means, and then re-feeds the sheets one by one from the cassette into the same image forming apparatus. The transporting means catches a sheet with rollers and allows the sheet to be widthwise curved, whereby the sheet is transported into the cassette. A plurality of cassettes is prepared in accordance with sheet sizes and is detachable from a main body of the sheet re-feeding apparatus. Inside the cassette are disposed a projection to stack and store a sheet in a condition where the sheet is widthwise curved, stoppers separated by a space approximately equal to the width of a sheet, pressing means for pressing both side portions of a sheet, means for regulating the leading edge of a sheet, a flexible member for catching the leading edge of a sheet together with a stacking surface, and the like. Further, one drive roller functions not only as one component of the transporting means but also as one component of the sheet feeding means.

18 Claims, 27 Drawing Sheets

U.S. PATENT DOCUMENTS 4,272,180 6/1981 Satomi et al. ..... 355/3 SH
4,281,920 8/1981 Cross .
4,295,733 10/1981 Janssen et al. .
4,313,670 2/1982 Caldwell .
4,361,393 11/1982 Noto .
4,365,886 12/1982 Murakami et al. ..... 355/3 SH
4,368,972 1/1983 Naramore .
4,371,155 2/1983 Astero et al. .
4,376,529 3/1983 George et al. .
4,385,827 5/1983 Naramore .
4,411,515 10/1983 Kukucka et al. .
4,424,963 1/1984 Bartholet et al. .
4,473,425 9/1984 Baughman et al. .
4,497,478 2/1985 Reschenhofer et al. .
4,515,458 5/1985 Masuda et al. .
4,549,804 10/1985 Braun et al. .
4,564,185 1/1986 Hamlin et al. .
4,566,782 1/1986 Britt et al. .
4,573,789 3/1986 Wada ..... 355/3 SH
4,582,421 4/1986 Hamlin et al. .
4,592,651 6/1986 Oikawa et al. .
4,595,187 6/1986 Bober .
4,603,971 8/1986 Kukucka et al. .
4,626,156 12/1986 Baughman et al. .
4,647,034 3/1987 Sawa .
4,647,188 3/1987 Komiya et al. .
4,674,732 6/1987 Hori .
4,674,866 6/1987 Tanaka .
4,687,191 8/1987 Stemmle .
4,702,589 10/1987 Ito ..... 355/14 SH
4,718,657 1/1988 Otter et al. .
4,721,382 1/1988 Ito et al. .
4,730,206 3/1988 Sawada et al. ..... 355/24 X
4,743,945 5/1988 Ito et al. .
4,763,889 8/1988 Dei et al. .

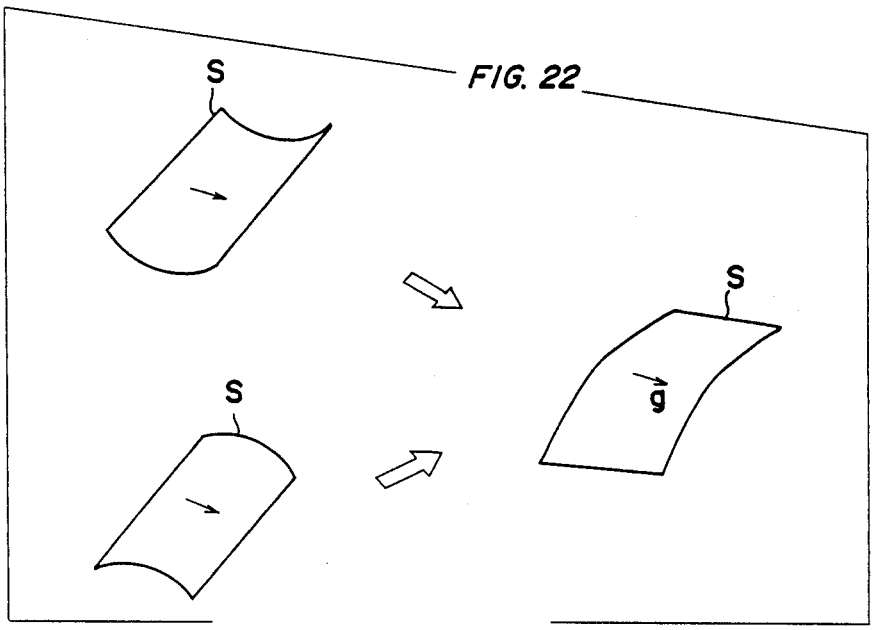
FIG. 22
FIG. 23 Prior Art
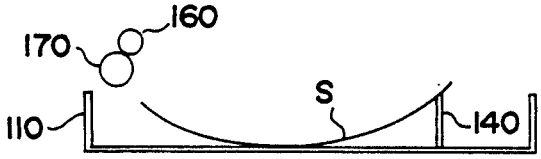
FIG. 24 Prior Art
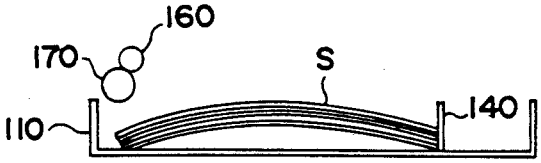

SHEET RE-FEEDING APPARATUS PROVIDED FOR IMAGE FORMING APPARATUS

BACKGROUND OF THE INVENTION

1. Field of the Invention

The present invention relates to a sheet re-feeding apparatus, and in particular, to a sheet re-feeding apparatus that once stores a sheet already bearing an image formed with an image forming apparatus such as an electrophotographic copying machine or a laser beam printer, and then re-feeds the sheet to the same image forming apparatus.

2. Description of Related Art

As for this type of sheet re-folding apparatus, various ones are conventionally proposed for duplex copying and composite copying, and most of them individually have a sheet storing/feeding unit incorporated. Further, in regard to sheet sizes, some apparatus have side stoppers movable according to each sheet size; other apparatus have side stoppers fixed to store and feed sheets of a limited size.

However, when a sheet storing/feeding unit is incorporated into a sheet re-feeding apparatus, cumbersome procedures are required to remove sheets jammed in this unit. In the case of movable side stoppers, special means is required to allow the stoppers to move to a position corresponding to each sheet size, resulting in a large-sized, expensive apparatus. In the case of fixed side stoppers, only sheets of a limited size are available. Further, while a sheet is transported to the sheet storing/feeding unit, the sheet becomes slightly skewed in the widthwise direction. Accordingly, when the above-mentioned side stoppers are separated by a space equal to the width of a sheet, the side edges of the sheet interfere with the side stoppers, thereby causing problems such as sheet jamming or others.

Additionally, with an image forming apparatus that has a sheet heating unit or records an image on rolled sheet, an ejected sheet is curled. For example, as shown in FIG. 23, when such a sheet is stored in a cassette 110, there is a possibility of the leading edge of the sheet going over a rear stopper 140. Contrarily, as shown in FIG. 24, when feeding a sheet to or from the cassette 110, there is a possibility that the leading edge of the sheet slips under the stopper 140 or does not reach a sheet feeding roller 170; thus, the sheet is not fed.

On the other hand, to this type of sheet re-feeding apparatus are disposed a storing roller for transporting a sheet into the sheet storing/feeding unit and a sheet feeding roller for feeding a sheet from the sheet storing-/feeding unit. Incidentally, when one drive roller is used both as a sheet feeding and a storing roller in order to simplify the constitution of a roller portion, there is a problem wherein when a sheet having been transported for storage through the roller is elevated for feeding the sheet while maintain its horizontal position, the leading edge of the sheet does not reach the roller.

In order to solve this problem, it is initially proposed to allow a stored sheet to move to the sheet feeding position together with the stoppers. However, in this case, a special means for moving the stoppers is required, resulting in a complicated and expensive apparatus. Secondly, it is proposed that a stopper be provided at a distance shorter from the roller than the distance of the sheet length. By this arrangement the leading edge of a sheet on its way to storage touches the stopper, whereby the sheet is forcibly looped and stored. Then, the loop of the stored sheet is weight-corrected, whereby the leading edge of the sheet relative to the sheet feeding direction is set below the roller. However, in this case, a rigid sheet cannot slip out of the roller during storing of the sheet, thus failing to store the sheet. Thirdly, it is proposed to allow stored sheets to slide to the sheet feeding position by inclining a sheet storing container. However, in this case, special means is required to incline the sheet storing container, resulting in a complicated and expensive apparatus. Further, there is a possibility that the leading edge of a sheet to be fed will be crimped, thereby causing sheet jamming.

Incidentally, an apparatus that can feed one by one a plurality of sheets having once been stored includes fixed-sheet-feeding-roller types and movable-sheet-feeding-roller types. For example, a fixed-roller type disclosed in Japanese Laid Open Publication No. 60-101339 is the above-mentioned drive-roller type, wherein one roller is used for sheet storing/feeding functions. In this case, an arrangement is provided so that a roller having two functions is secured at a fixed position and an elevating plate is drawn by a spring toward the roller, whereby the roller is allowed to contact and press sheets. However, in this case, the pressure of the roller on the sheets changes in accordance with the quantity of the remaining stored sheets; thus, a sheet is not fed or two sheets are erroneously fed at one time.

On the other hand, with a movable-roller type, an arrangement is so provided that in the feeding of a sheet a roller moves down to press stored sheets. However, in this case, the sheet feeding position changes in accordance with the quantity of the remaining stored sheets; a sheet is not fed or two sheets are erroneously fed at one time.

Further, when one roller is used for sheet storing-/feeding functions, the following contradictory problem must be solved. More specifically, with a conventional sheet re-feeding apparatus, a sheet is fed by one or two rollers disposed at the middle portion. When a sheet is fed by more than three rollers disposed parallel to one another, it is difficult to equalize the sheet feeding pressures of rollers on the sheet, thus inevitably causing sheet-skewing. On the other hand, when storing a sheet, a plurality of rollers is required to assuredly transport a sheet for storage. More specifically, when one roller is used for both the sheet storing/feeding functions, it is required to solve a contradictory problem, wherein in the case of storing a sheet it is desirable to transport a sheet by means of a large number of rollers, while in the case of feeding a sheet it is desirable to feed a sheet by means of a small number of rollers.

SUMMARY OF THE INVENTION

In order to solve the above-mentioned problems, according to the invention, an improved and satisfactory sheet re-feeding apparatus is provided for an image-forming apparatus.

A main object of the present invention is to provide a small-sized, inexpensive sheet re-feeding apparatus, wherein duplex copying for various sheet sizes is allowed by exchanging one cassette for another without moving side stoppers in accordance with each sheet size, and which can readily remove sheet jamming caused in a sheet re-feeding unit by detaching the cassette.

Another object of the present invention is to provide a sheet re-feeding apparatus, wherein when a sheet having an image formed thereon is stored in a sheet storing means, the side edges of the sheet do not touch the side stoppers, thus preventing problems such as sheet jamming or others.

Still another object of the present invention is to propose a sheet re-feeding apparatus that, by providing a sheet on the way to storage with rigidness, prevents the leading edge of the sheet from going over or sliding under a stopper, thereby preventing failures in sheet transporting.

Still another object of the present invention is to provide a sheet re-feeding apparatus wherein one drive roller is used for sheet storing/feeding functions and that can store sheets below the roller so as to assuredly feed the sheets from the storing means.

Still another object of the present invention is to provide a sheet re-feeding apparatus having one drive roller that provides not only a sheet storing but also a sheet feeding function, wherein during feeding of stored sheets both the level of the top sheet and height of the roller are maintained constant despite the quantity of the remaining stored sheets; the pressure of the roller on the sheets is also maintained constant, thereby preventing problems such as sheet jamming or others.

The final object of the present invention is to provide a sheet re-feeding apparatus that can ensure proper sheet storing/feeding operations.

To attain the above objects, a sheet re-feeding apparatus according to the present invention comprises a cassette for storing sheets having an image formed thereon in a stack and being detachable from a main body of the sheet re-feeding apparatus, whose size corresponds to the size of the sheets to be stored in said cassette, transporting means for transporting the sheets having an image formed thereon from said image forming apparatus to said cassette and sheet feeding means feeding the sheets having been stored in said cassette one by one to said image forming apparatus. The cassette is selectively exchanged for another in accordance with the size of sheets to be used. Therefore, if sheet jamming is caused within the apparatus, a jammed sheet can be readily removed by drawing out the cassette.

Further, a sheet re-feeding apparatus of the present invention comprises sheet storing means for storing the sheets having an image formed thereon, which includes a pair of stoppers separated by a space approximately equal to the width of the sheet, and said stoppers regulates both of the lateral side edges of the sheet, transporting means for transporting the sheets having an image formed thereon from the image forming apparatus to said sheet storing means in a condition where the sheet is curved widthwise, and sheet feeding means for feeding the sheets having been stored in said sheet storing means one by one to said image forming apparatus. While a sheet is transported to the sheet storing means, the sheet is curved by the transporting means in the widthwise direction, thereby allowing the width of the sheet to be reduced. Therefore, there are slight spaces between stoppers separated by a space equal to the width of a flat sheet and the side edges of a sheet on the way to storage. Correspondingly, if a sheet has been skewed during the previous transport process, the above-mentioned spaces prevent interference between the side edges of the sheet and the stoppers.

Additionally, with the sheet re-feeding apparatus, the sheet storing means can hold a sheet stacked in a condition where the sheet is curved in the widthwise direction. By curving a sheet in this manner, the sheet is provided with a rigidness relative to the transporting direction, thereby correcting curls or others of the sheet.

Further, with the sheet re-feeding apparatus, the sheet storing means comprises regulating means provided on the sheet storing means and capable of moving back and forward relative to the sheet transporting direction, which can contact and regulate the leading edge of a sheet transported by the transporting means, means for actuating said regulating means in the direction reverse to the sheet transporting direction, and means for preventing said regulating means at a specific position from moving in the direction reverse to the sheet transporting direction. In this case, the leading edge of a sheet on the way to storage contacts the regulating means, which pivotally moves in the sheet transporting direction against the drive means. Following this movement of the regulating means, the whole sheet drops in the sheet storing means and separates from the storing rollers, whereby the regulating means pivotally moves back in the direction reverse to the sheet transporting direction, allowing the sheet to be set at a specific position.

Further, with the sheet re-feeding apparatus, the sheet storing means comprises pressing means provided to the sheet storing means, which touch the leading edge of the sheet transported by the transporting means, whereby the leading edge of the sheet is guided in the direction of a sheet stacking surface and pressed on the sheet stacking surface after having been stored. When a sheet is transported into the sheet storing means, the pressing means presses the leading edge of the transported sheet onto the sheet stacking surface, thereby correcting curls of the sheet.

At the same time, a sheet re-feeding means comprises said storing means, a drive roller disposed above the sheet storing means and capable of moving lower position and sheet elevating means for elevating the top sheet, whereby the drive roller is allowed to touch the top sheet due to its weight. In the case of feeding sheet from the sheet storing means, as the quantity of the remaining stored sheets is reduced, the sheet elevating means moves until the top of the sheets reaches an specific upper portion, whereby the sheets are elevated together with the drive roller. Therefore, the position (height) of a sheet to be fed from the sheet storing means is always maintained constant despite the quantity of the remaining stored sheets, and the pressure of the drive roller on a sheet is also maintained constant.

Further, with the sheet re-feeding apparatus, sheet storing/feeding means comprises a drive roller disposed above the sheet storing means and in the middle portion relative to the sheet widthwise direction, which moves up and down between the sheet feeding position where the drive roller contacts the top sheet and the storing position where the drive roller separates from the top sheet, auxiliary rollers disposed on the same pivot as the drive roller, which move up and down together with said drive roller and whose diameter is smaller than that of said drive roller, and storing rollers disposed above said drive roller and said auxiliary rollers, which store the sheet in the sheet storing means in conjunction with said drive roller and said auxiliary rollers. When storing a sheet, the drive roller and auxiliary rollers, which are disposed on the same pivot, catch the sheet together with the storing rollers opposite to these rollers, whereby the sheet is transported to the sheet storing means for storage. On the other hand, when feeding a sheet from the sheet storing means, the sheet does not contact the auxiliary rollers of a short diameter but contacts only the drive roller of a large diameter, whereby the sheet receives the feeding power of the drive roller and is fed from the sheet storing means.

BRIEF DESCRIPTION OF THE DRAWINGS

These and other objects and features of the present invention will become apparent from the following description taken in conjunction with the preferred embodiments thereof with reference to the accompanying drawings, in which:

FIG. 1 through FIG. 28 show an embodiment according to the present invention.

FIG. 1 is a schematic diagram showing the general constitution of a copying apparatus including a sheet re-feeding apparatus according to the invention.

FIGS. 2 and 3 are schematic diagrams showing the constitution of the sheet re-feeding apparatus and are used to explain how sheets are fed to or from the same apparatus.

FIGS. 4 and 5 are perspective side views showing the constitution of a driving system.

FIG. 6 is a plan view showing the constitution and mounting mechanism of a cassette.

FIGS. 7 through 9 are perspective side views of a portion of the cassette.

FIG. 10 is a cross sectional view of the cassette.

FIGS. 11 and 12 are sectional views of a portion of the sheet re-feeding apparatus.

FIGS. 13 through 15 are longitudinal sectional views of the cassette.

FIG. 16 is a perspective side view showing important elements of the sheet re-feeding apparatus.

FIG. 17 is a sectional view of a manipulation roller portion.

FIGS. 18 through 21 are front views showing an elevating mechanism and a canceling mechanism for each operative position.

FIG. 22 presents perspective side views used to explain how a sheet is curled due to heat and how a curled sheet is stored.

FIGS. 23 and 24 are schematic diagrams outlining an example of a sheet stored in an unsatisfactory condition.

FIG. 25 is a plan view of a control panel.

FIG. 26 is a block diagram of a control circuit.

FIGS. 27 and 28 are flow charts showing a control procedure.

FIG. 36 is a perspective side view of a portion of rear regulating means.

FIG. 37 is a perspective side view showing a rear portion of the cassette.

FIGS. 38 and 39 are longitudinal sectional views of the cassette.

DETAILED DESCRIPTION OF THE INVENTION

[General constitution and operation of copying apparatus]

Figure 1:
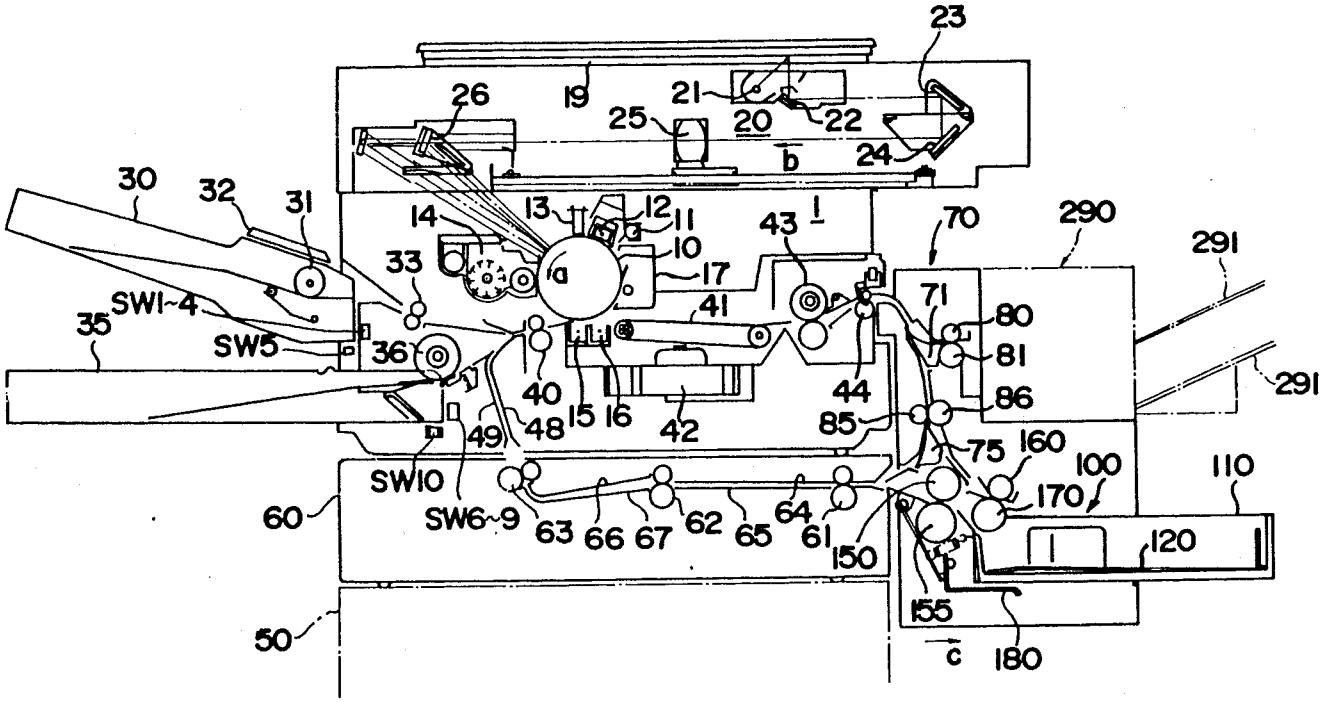

In FIG. 1, a copying apparatus 1 is disposed upon a base desk 50 through a re-fed sheet passing box 60. In the approximate middle of the copying apparatus 1 is disposed a photosensitive drum 10 rotatable in the direction of an arrow a at a predetermined peripheral velocity V. Around the photosensitive drum 10 are sequentially disposed a main eraser 11, an electrifying charger 12, a suberaser 13, a magnetic brush-type developing unit 14, a transfer charger 15, a sheet separation charger 16 and a blade-type cleaning device 17. During each copying operation, while rotating in the direction of an arrow a, the photosensitive drum 10, having a well-known photosensitive layer on the surface thereof, is neutralized and electrified by the main eraser 11 and the electrifying charger 12, has its unnecessary portions then neutralized by the suberaser 13, and is further subjected to imagewise exposing from an optical system 20 to form an electrostatic latent image. The electrostatic latent image becomes a toner image using the developing unit 14.

The optical system 20 capable of scanning an original image is disposed under a platen glass 19 and comprises an exposure lamp 21, a first mirror 22, a second mirror 23, a third mirror 24, an image-projecting lens 25, and a fourth mirror 26. The exposure lamp 21 and the first mirror 22 are integrally constituted and can move in the direction of an arrow b at a velocity of V/m (m: copying magnification) relative to the peripheral velocity V of the photosensitive drum 10 (constant regardless of whether the current magnification is an equal magnification or a modified magnification). The second mirror 23 and the fourth mirror 24 are integrally constituted and can move in the direction of an arrow b at a velocity of V/2m. In modifying a copying magnification, the lens 25 moves along the optical axis, accompanying the movement and oscillation of the fourth mirror 26 so as to correct the optical path.

On the other hand, copying sheets are loaded in to a stationary, automatic feeding cassette 30 and a detachable automatic feeding cassette 35, which are both disposed on the left side of the copying apparatus 1. The copying sheets are fed one by one by selectively rotating either of feeding rollers 31 or 36. Further, the top side of the cassette 30 is a manual feeding portion 32 from which copying sheets are fed one by one. A sheet fed from the cassette 30 or the manual feeding portion 32 is conveyed to a pair of timing rollers 40 through a conveyor roller 33; or a copying sheet fed from the cassette 35 is conveyed directly to the pair of timing rollers 40, where the copying sheet stops once. The copying sheet at the pair of timing rollers 40 is synchronized with the image formed on the surface of the photosensitive drum 10 and conveyed to a transfer portion to come in close contact with the photosensitive drum 10 where a toner image is transferred onto the copying sheet by means of the corona discharge of the transfer charger 15. Then, the copying sheet is separated from the photosensitive drum 10 by means of the AC corona discharge of the separation charger 16. Further, the copying sheet is drawn through the conveyor belt 41, which is provided with an air suction unit 42, and conveyed to a fixing unit 43 where the toner image is fixed to the copying sheet; the copying sheet is then ejected through a pair of ejection rollers 44.

On the other hand, the post-transfer photosensitive drum 10 has residual toner and charge on the surface thereof removed by the cleaning device 17 and the main eraser 11 in preparation for the next transfer process.

Incidentally, in the locations where the above-mentioned cassettes 30 and 35 are mounted on to the copying apparatus 1 are disposed sheet-size-detecting switches SW1 through SW4, similar switches SW6 through SW9, and sheet-detecting switches SW5 and SW10. The sheet-size-detecting switches SW1 through SW4 are respectively turned ON or OFF in accordance with the position of projections or magnets provided on the cassette 30; and the similar switches SW6 through SW9 are respectively turned ON or OFF in accordance with the position of a similar projections or magnets provided on the cassette 35. When in the ON status, each of the above switches detects, based on a 4-bit code signal, whether the cassette 30 or 35 is attached or detached, as well as the size of the copying sheets loaded in the cassette 30 or 35. The sheet-detecting switch SW5 or SW10 directly detects whether there is a copying sheet in the cassette 30 or 35.

[General constitution and sheet passing function of duplex and composite copying unit]

Figure 2:
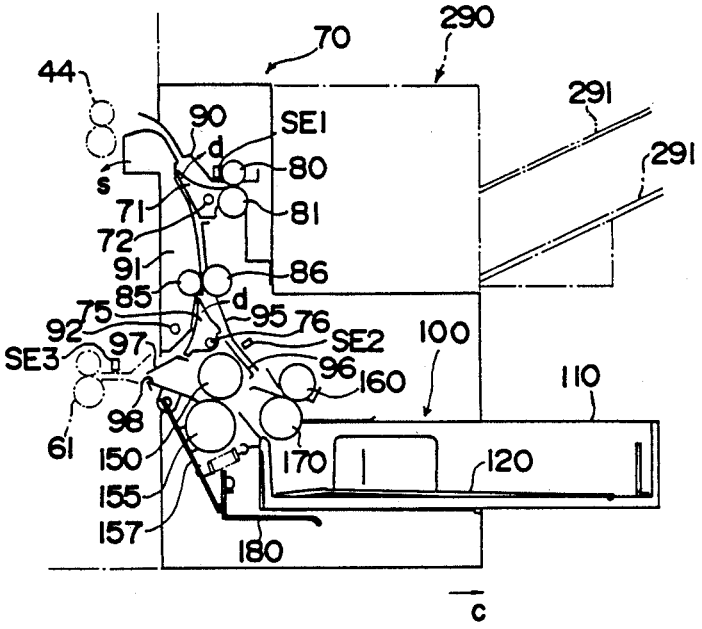
Figure 3:
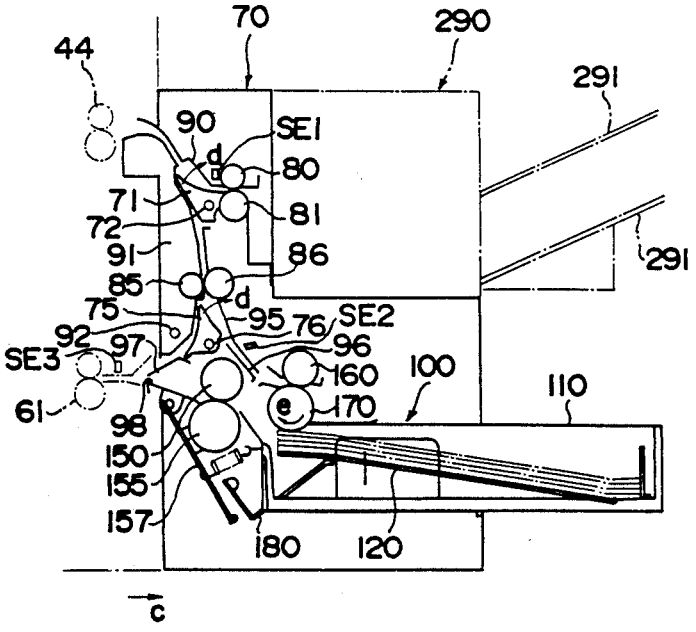

As shown in FIGS. 1, 2, and 3, a duplex and composite copying unit 70 generally comprises a first switching tongue 71, a second switching tongue 75, ejection rollers 80 and 81 correspondingly located around the switching tongues 71 and 75, transporting rollers 85 and 86, guide plates 90, 91, and 95 through 98, and a sheet re-feeding apparatus 100 described later in detail, and at the back of the same unit 70 is disposed a sorter 290, including a plurality of bins 291 and an unshown sheet ejection tray. The duplex and composite copying unit 70 is placed on an unshown rail attached to a re-fed sheet passing box 60 and can be separated from the copying apparatus 1 in the direction of an arrow c.

The first switching tongue 71 and the second switching tongue 75 can pivotally move on pivots 72 and 76 by turning a solenoid ON or OFF. In the normal copying mode (one-side copying mode), the first switching tongue 71 is set at the position of the solid line in the figure, and a copying sheet having been ejected from the pair of ejection rollers 44 is transported into the sorter 290 through the ejection rollers 80 and 81. In the duplex copying mode or the composite copying mode, the first switching tongue 71 rotates in the direction of an arrow d and guides the sheet to the transporting rollers 85 and 86 through the guide plates 91 and 95.

At the same time, in the duplex copying mode, the second switching tongue 75 is set at the position of the solid line in the figure, whereby a sheet is guided to a sheet-storing roller 160 and a drive roller 170 through the guide plates 95 and 96. Then, the sheet is stored in a cassette 110 described later in detail. Once storing of a predetermined number of sheets has been completed, a base plate 120 on the cassette 110 is elevated, whereby copying sheets are fed from the cassette 110 one by one through the rotation of the drive roller 170 in the direction of an arrow e, and then fed from a feed roller 150 and a manipulation roller 155 to the re-fed sheet passing box 60 through guide plates 97 and 98. In the composite copying mode, the second switching tongue 75 rotates in the direction of an arrow d, whereby the sheet is fed to the re-fed sheet passing box 60 through the guide plates 91 and 97 by the transporting rollers 85 and 86.

As shown in FIG. 1, the re-fed sheet passing box 60 comprises transporting rollers 61 trough 63 and guide plates 64 through 67. The re-fed sheet is transported from the transporting rollers 62 to the above-mentioned pair of timing rollers 40 through guide plates 48 and 49.

At the same time, along the above-mentioned transport path are disposed sheet-detecting sensors SE1, SE2, and SE3. The sensor SE1 detects a sheet transported by the ejection rollers 80 and 81; the sensor SE2 detects a sheet stored into the cassette 110; and the sensor SE3 detects a sheet fed into the re-fed sheet passing box 60.

[Constitution of driving system of duplex and composite copying unit]

Figure 4:
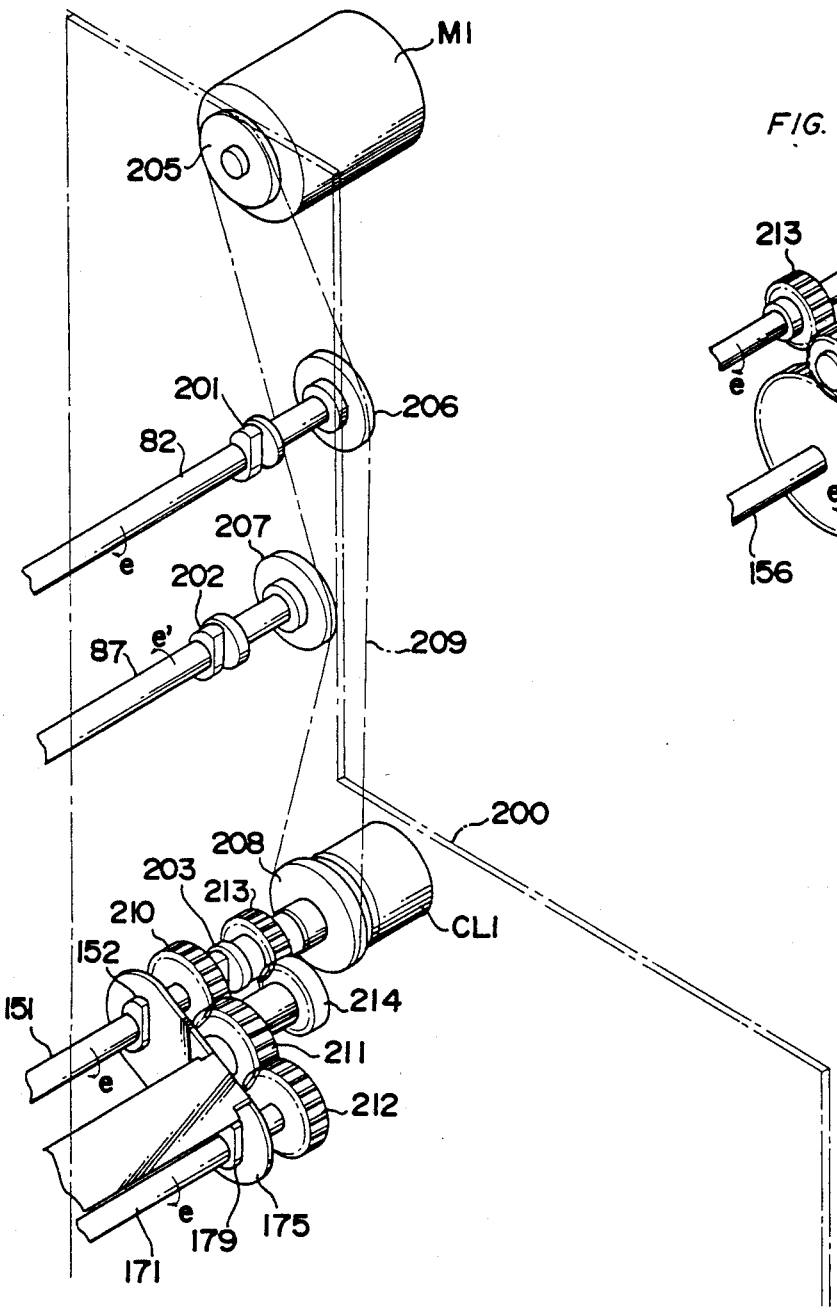
Figure 5:
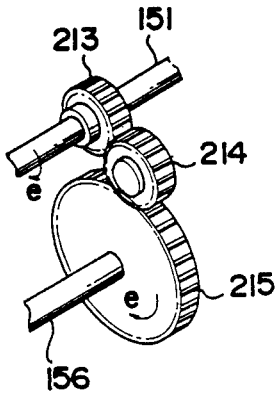

As shown in FIGS. 4 and 5, various rollers contained in the duplex and composite copying unit 70 are driven by a motor M1. A pivot 82 supports the ejection roller 81, a pivot 87 the transporting roller 86, and a pivot 151 the feed roller 150. These pivots are rotatably attached to the frame 200 of the unit 70 through bearings 201, 202, and 203. Sprockets 206 and 207 are secured to the ends of pivots 82 and 87, and a sprocket 208 is secured to the end of the pivot 151 through an electromagnetic clutch CL1. Sprockets 206 through 208 and a sprocket 205 for turning ON the motor M1 are tied together by a roller chain 209. Therefore, by turning ON the motor M1, the ejection roller 81 rotates in the direction of an arrow e together with the pivot 82, and the transporting roller 86 rotates in the direction of an arrow e' together with the pivot 87. At the same time, by turning ON the electromagnetic clutch CL1, the feed roller 150 rotates in the direction of an arrow e together with the pivot 151. Further, the ejection roller 80 and the transporting roller 85 follow the rotation of the rollers 81 and 86.

Additionally, one end of a frame 175 capable of pivotally moving is attached onto the pivot 151 through a bearing 152, and to the other end of the frame 175, a pivot 171 is rotatably attached through a bearing 179. The pivot 171 supports the drive roller 170, and a gear 212 secured to the end of the pivot 171 is connected to a gear 210 secured to the above-mentioned pivot 151 through an idle gear 211. Therefore, the drive roller 170 rotates in the direction of an arrow e together with the feed roller 150, and a sheet-storing roller 160 simultaneously follows their rotation.

On the other hand, as shown in FIG. 5, a pivot 156 supports the manipulation roller 155, and a gear 215 secured to the end of the pivot 156 is, through an idle gear 214, connected to a gear 213 secured to the above mentioned pivot 151. Therefore, the manipulation roller 155 rotates in the direction of an arrow e together with the feed roller 150.

[Constitution and mounting mechanism of cassette]

As shown in FIGS. 6 through 10, the cassette 110 of a box shape generally comprises a base plate 120, side stoppers 130, and a rear-end stopper 140. The base plate 120 disposed to be able to pivotally move up and down on a hinge fitting 125, which is attached to the rear end of the base plate 120. A cassette 110 is exclusively used for each size of copying sheet, and stoppers 130 and 140 are secured to positions predetermined in accordance with each sheet size. Additionally, an opening 111 provided on the cassette 110 allows an elevating plate 180 described later to enter the cassette 110, and an opening 112 allows in the optical axis of a light-transmission-type photosensor SE4 together with a opening 121 provided on the base plate 120. (See FIG. 16) The sensor SE4 is disposed so as to detect whether or not any sheets exist in the cassette 110.

A holder 220 to hold the cassette 110 is secured to frames 200 and includes a cassette-detecting switch SW11 and springy claws 221 attached on the both sides thereof. When the cassette 110 is inserted in the direction of an arrow A in FIG. 6, the springy claws 221 go over projections 113*a* and engage with grooves 113*b* to hold the cassette 110 on the holder 220. In this case, a projection 115 provided to the forward end of the cassette 110 turns ON the switch SW11, whereby the switch SW11 detects mounting of the cassette 110.

Additionally, onto the holder 220 are provided reed switches SW12 through SW15 and SW16 as well as the above-mentioned switch SE4 for detecting any sheets in the cassette 110. Any of the reed switches SW12 through SW15 is turned ON or OFF by respective magnets 108, which in accordance with each sheet size is set in any of the four holes 116 provided at the bottom of the cassette 110. When in the ON status, each reed switch detects the size of sheets that can be contained in the cassette 110 based on a 4-bit code signal. The reed switch SW16 is turned ON by a magnet 109 provided on the bottom of the cassette 110, and detects the mounted cassette 110 as being a cassette for duplex copying.

Figure 6:
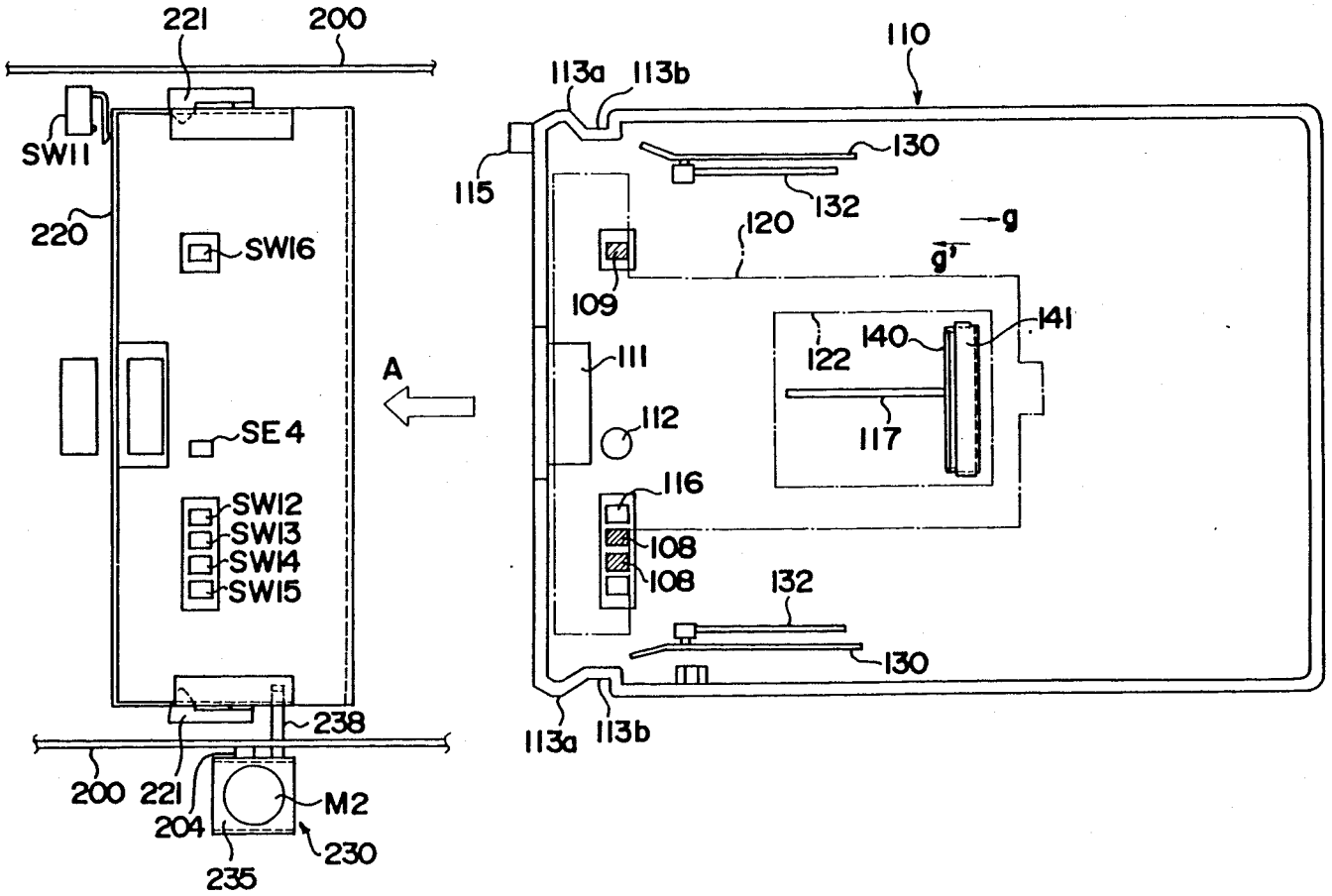
Figure 7:
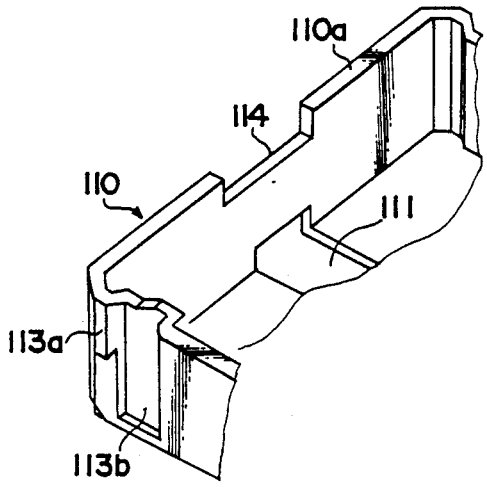
Figure 8:
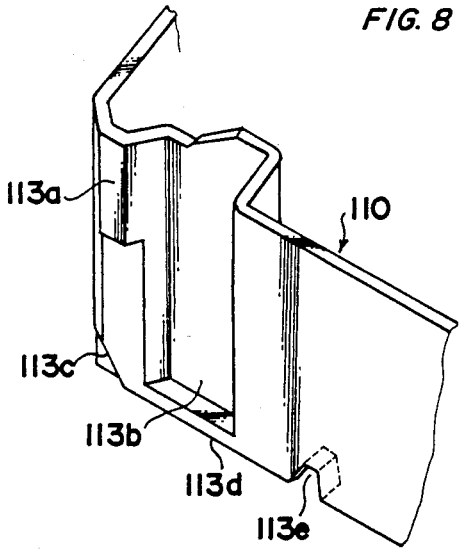
Figure 9:
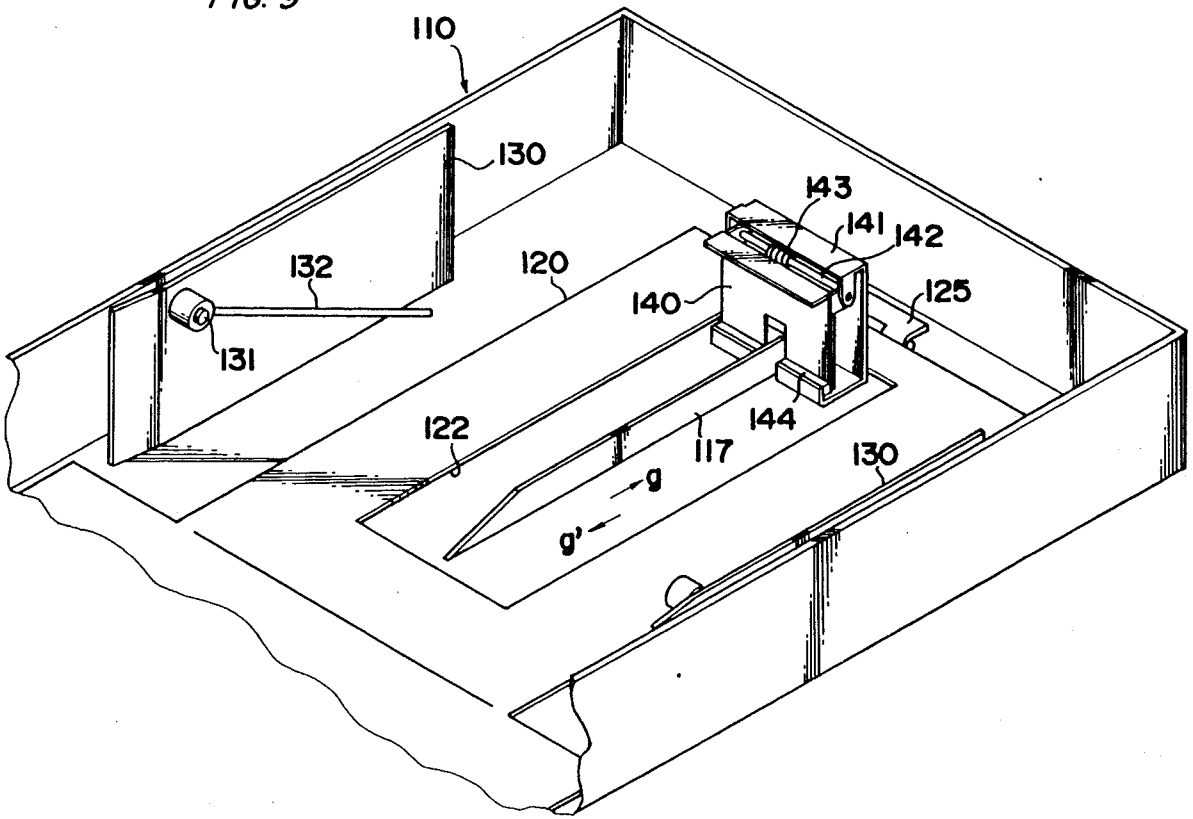
Figure 10:
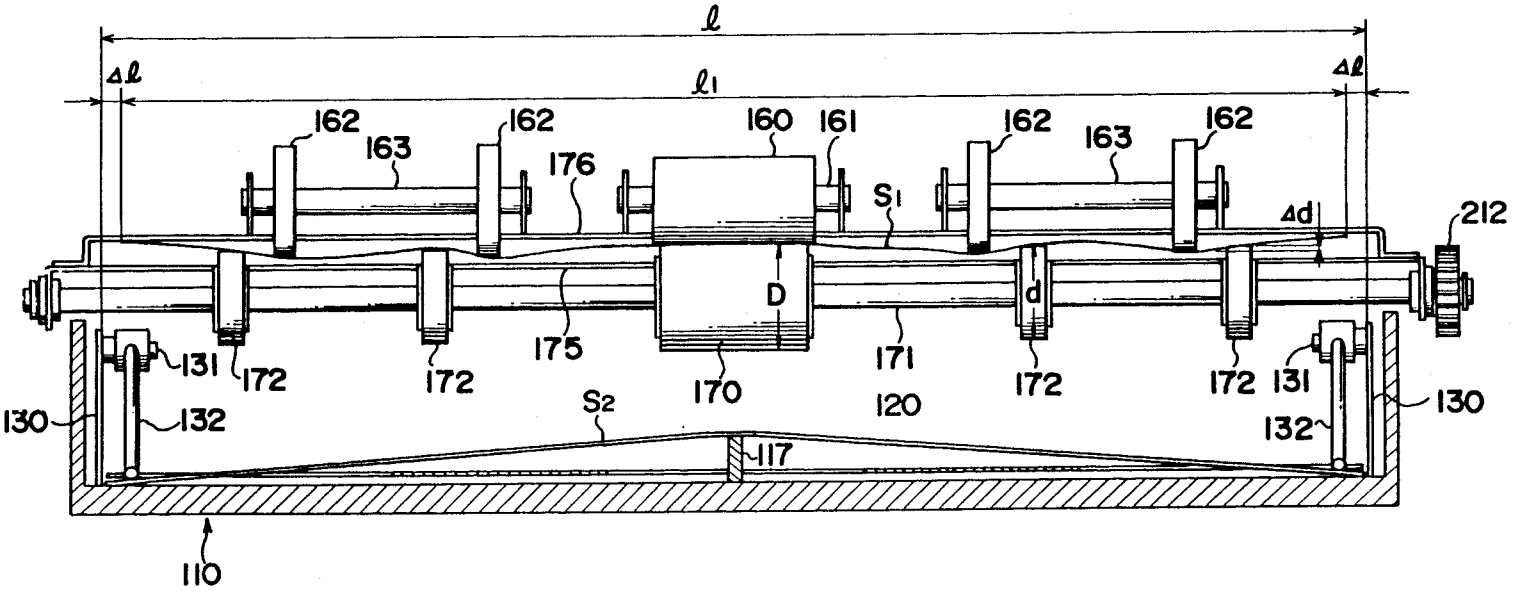

On the other hand, as shown in FIGS. 6 and 9, a long and slender projection 117 is provided on the cassette 110 through an opening 122 of the base plate 120 in the direction parallel to the sheet passing directions g and g'. Additionally, on the inner sides of side stoppers 130 are disposed levers 132 for pressing the side ends of a sheet, which can pivotally move on pins 131. As shown in FIG. 10, when a sheet S2 has been stored in the cassette 110, the middle portion of the sheet rises due to the projection 117 and the both side ends of the sheet are pressed by pressing levers 132, forming a smooth curve whose crest corresponds with the middle portion of the sheet relative to the sheet storing direction, whereby the sheet is rigidly provided in the sheet containing direction.

In general, a sheet S having passed the fixing unit 43 is curled upward or downward due to heat. As shown in FIG. 23, a sheet curled upward due to heat is capable of going over the rear stopper 140. Contrarily, as shown in FIG. 24, there is a possibility that the leading edge of a sheet curled downward does not reach the drive roller 170 or slips under the rear stopper 140 during feeding of a sheet from or to the cassette 110, thus failing to feed the sheet. However, with this embodiment, such a problem is prevented by providing rigidness in the sheet storing direction to the stored sheet S2. Additionally, the side stoppers 130 are secured to the positions predetermined in accordance with the size of sheets containable in the cassette 110, and the pressing levers 132 are attached to the side stoppers 130. Therefore, it is not required to determine specific positions for the attachment of the pressing levers 132 in accordance with each size.

[Constitution and sheet storing and feeding operations of drive roller]

Figure 11:
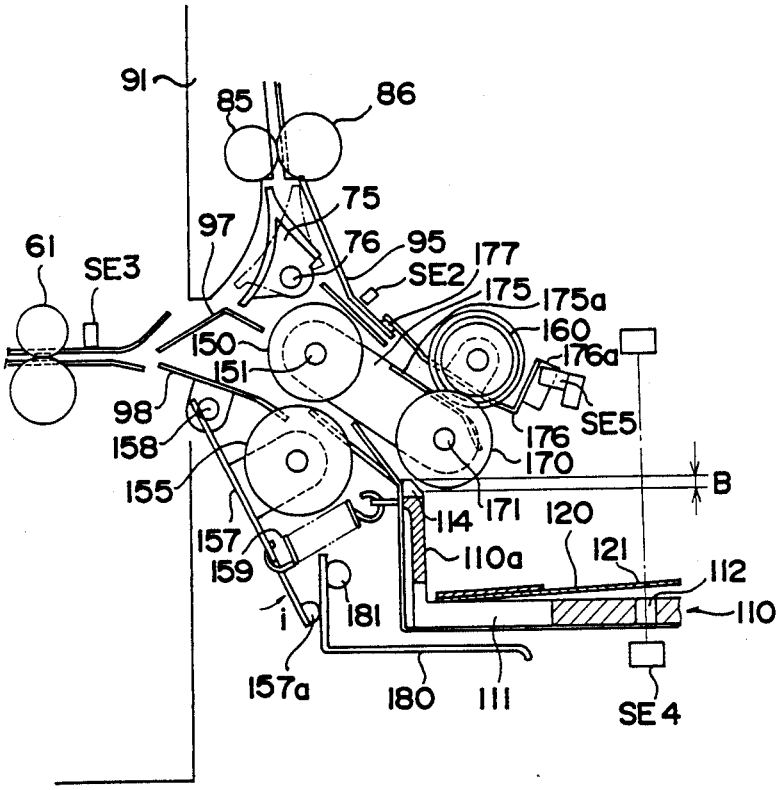
Figure 12:
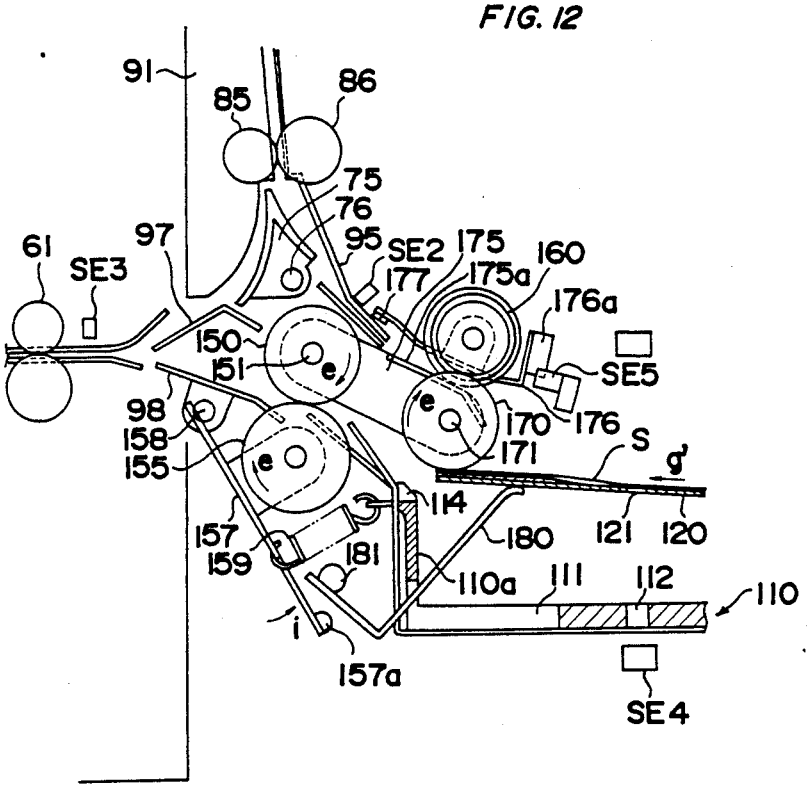

With this embodiment, the drive roller 170 has not only a transporting function for storing a sheet into the cassette 110 but also a sheet feeding function for feeding a sheet from the cassette 110. When storing a sheet in the cassette 110, the drive roller 170 is at a lower position as shown in FIG. 11. When feeding a sheet from the cassette 110, the same roller 170 is at an upper position as shown in FIG. 12, catching a sheet S between the roller 170 and the elevated base plate 120.

More specifically, as mentioned above, the drive roller 170 is attached through a pivot 171 to a frame 175 capable of pivotally moving and on a pivot 151 of the feed roller 150, and the storing roller 160 is rotatably attached to an upper frame 176, which is integrally constituted with the frame 175. Incidentally, both the flat portion 175*a* of the frame 175 and the upper frame 176 function as sheet guide plates in storing a sheet. The frame 175 is drawn downward on the pivot 151 because of the weight of the rollers 160 and 170. In this case, a flexible projection 177 provided onto the end of the upper frame 176 touches the lower end of the above-mentioned guide plate 95, whereby the drawing power is restricted. (See FIG. 11) In storing a sheet, the drive roller 170 stops at a lower position and partially overlaps by B the upper end of a front stopper 110*a* of the cassette 110.

The overlap B is provided to prevent a sheet having been stored in the cassette 110 from moving in the sheet feeding direction of an arrow g' and protruding to the vicinity of the manipulation roller 155, by means of the drive roller 170. In the case of a curled sheet or others, there is a possibility of the sheet having been stored in the cassette 110 moving in the sheet feeding direction and of the leading edge of the sheet going over the front stopper 110*a*. Such a sheet movement can be prevent by means of the drive roller 170 having an overlap B. Incidentally, even if the overlap B is zero, the same effect is attained.

Additionally, a notch 114 is provided at the top of the front stopper 110*a* at a position corresponding to the drive roller 170, so as to prevent the front stopper 110*a* from interfering with the drive roller 170 in the attachment and detachment of the cassette 110.

On the other hand, as shown in FIG. 12, in feeding a sheet, the elevating plate 180 is actuated by a motor M2 of the elevating mechanism 230 described later and pivotally moves upward on a pivot 181, whereby the base plate 120 is elevated at the same time, allowing the sheet stored on the base plate 120 to touch and press the drive roller 170. In this case, together with the drive roller 170 the frame 175 and the storing roller 160 are also elevated. The elevating of the elevating plate 180 for the base plate 120 and the drive roller 170 is canceled when a projection 176*a* of the upper frame 176 releases the optical axis of a photosensor SE5 and a signal from the sensor SE5 turns OFF the motor M2. (See FIG. 16)

Then, a signal to begin copying of the reverse side of the copied sheet is provided from the copying apparatus 1, and the above-mentioned clutch CL1 is turned ON to rotate the drive roller 170 in the direction of an arrow e, whereby sheets are fed one by one beginning at the top sheet. At the same time, the feed roller 150 and the manipulation roller 155 also rotate in the direction of an arrow e to feed the sheets one by one to the re-fed sheet passing box 60. When the leading edge of the fed sheet is caught between the pair of transporting rollers 61, the clutch CL1 is turned OFF, whereby the rotation of rollers 170, 150, and 155 is canceled. However, since a one-way clutch is incorporated into the rollers 170 and 150, even if the rotations of the rollers are canceled, the sheet is transported by the transporting power of the pair of transporting rollers 61, and the rotations of the rollers 170 and 150 follow by the operation of the one-way clutch.

The rotation of the rollers 170, 150, and 155 is canceled as follows: the timer is turned ON when the leading edge of a fed sheet is detected by the sensor SE3 in the box 60, and then the count of the timer is completed when the leading edge of the sheet is caught between the pair of transporting rollers 61, whereby the above-mentioned clutch CL1 is turned OFF.

Then, after the trailing edge of the fed sheet is detected by the sensor SE3, the clutch CL1 is turned ON again, whereby the rollers 170, 150, and 155 rotate to feed the next sheet.

When other sheets are fed using the same procedures as mentioned above, a decrease in the quantity of sheets causes the level of the top sheet to be lowered. In this case, the above-mentioned projection 176*a* of the upper frame 176 intercepts the optical axis of the photosensor SE5, and a signal indicating interception of the optical axis actuates the motor M1, whereby elevation occurs to maintain the level of the top sheet constant. By maintaining the level of top sheet constant despite the quantity of sheets remaining in the cassette 110, the height of a sheet to be fed relative to the manipulation roller 155 is maintained constant. In addition, the pressure of the drive roller 170 on a sheet is also maintained constant.

[Constitution and function of drive roller portion and sheet storing roller portion]

As shown in FIG. 10, onto the pivot 171 of the drive roller 170 are secured lower auxiliary rollers 172, which are separated by equal spaces with the drive roller 170 being at the center. The storing roller 160 presses the drive roller 170 in the middle of the above unit, and on both sides upper auxiliary rollers 162 correspondingly spaced apart from the lower auxiliary rollers 172 are rotatably disposed on the upper frame 176. The diameter of each lower auxiliary rollers 172 are smaller than that of the drive roller 170, and the auxiliary rollers 172 correspondingly overlap by $\Delta d$ the same rollers 162. Therefore, a sheet S1, on the way to being stored in the cassette 110, is caught on the middle portion thereof by the rollers 160 and 170 and on the side portion thereof by the auxiliary rollers 162 and 172, whereby the sheet is waved and provided with a rigidness relative to the sheet storing direction in order to allow storing of a sheet curled due to heat.

The space l between the side stoppers 130 corresponds to each size; for example, it is approximately 297 mm long. However, there is a possibility that a sheet ejected from the copying apparatus 1 skews in the widthwise direction while being transported to the sheet re-feeding unit 100. Therefore, with this embodiment, the width l1 of a sheet provided with rigidness relative to the sheet storing direction differs from the width l of a flat sheet by $\Delta l$, and the difference $\Delta l$ enables even a slightly-skewed sheet to be stored in the cassette 110 without touching the side stoppers 130.

Incidentally, with this embodiment, the pivots 163 of the upper auxiliary rollers 162 and the pivot 161 of the sheet storing roller 160 are independently disposed on the upper frame 17. Contrarily, when the rollers 160 and 162 are disposed on the same pivot, if a rigid sheet such as cardboard is transported the pressing power of the storing roller 160 becomes weaker than the rigidness of the sheet due to the overlaps $\Delta d$ between the auxiliary rollers 162 and 172, whereby the storing roller 160 becomes unstable, resulting in reduced transporting power. However, with this embodiment, the pivots 161 and 163 are independently separated from each other in order to provide rigidness to a sheet, whereby the sheet is successfully transported into the cassette 110. Incidentally, a sheet S1 on the way to storage is provided with rigidness exclusively by the operation of the auxiliary rollers 162 and 172.

Additionally, since the diameter of the drive roller 170 is longer than that of each auxiliary roller 172 as mentioned above, in feeding a sheet, only the drive roller 170 presses the middle portion of a sheet to enable the sheet to be successfully transported and thereby preventing it from skewing. Incidentally, the drive roller 170 may be divided into more than two blocks.

[Constitution and function of the rear stopper]

Figure 13:
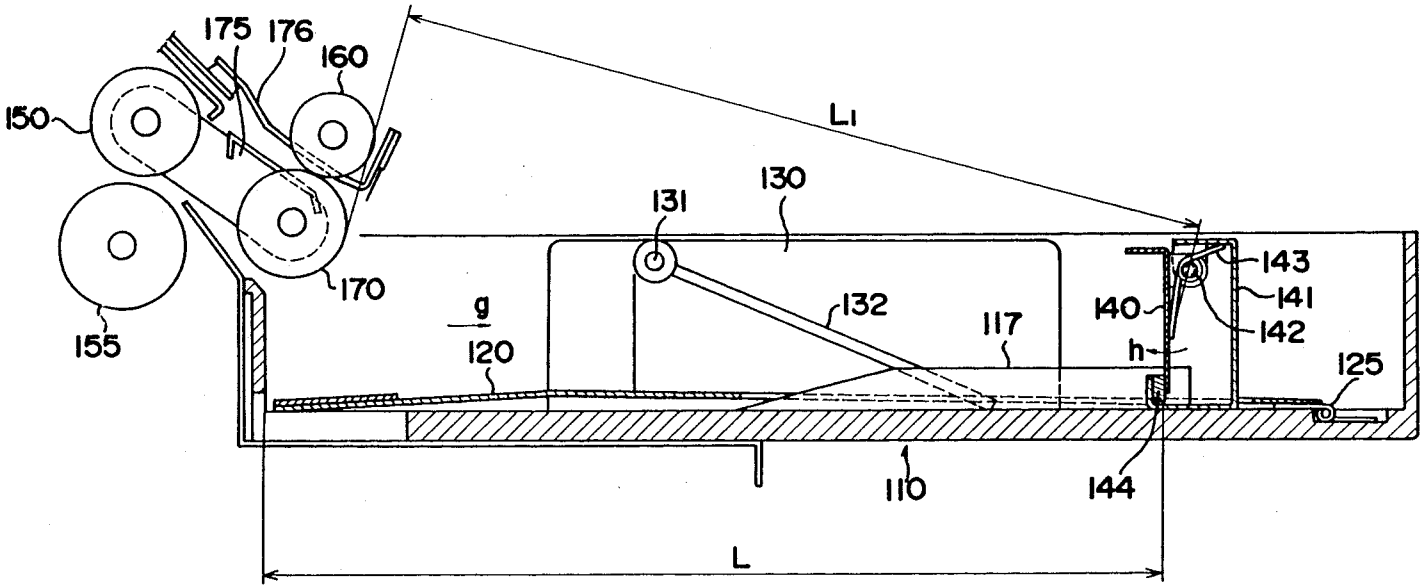
Figure 15:
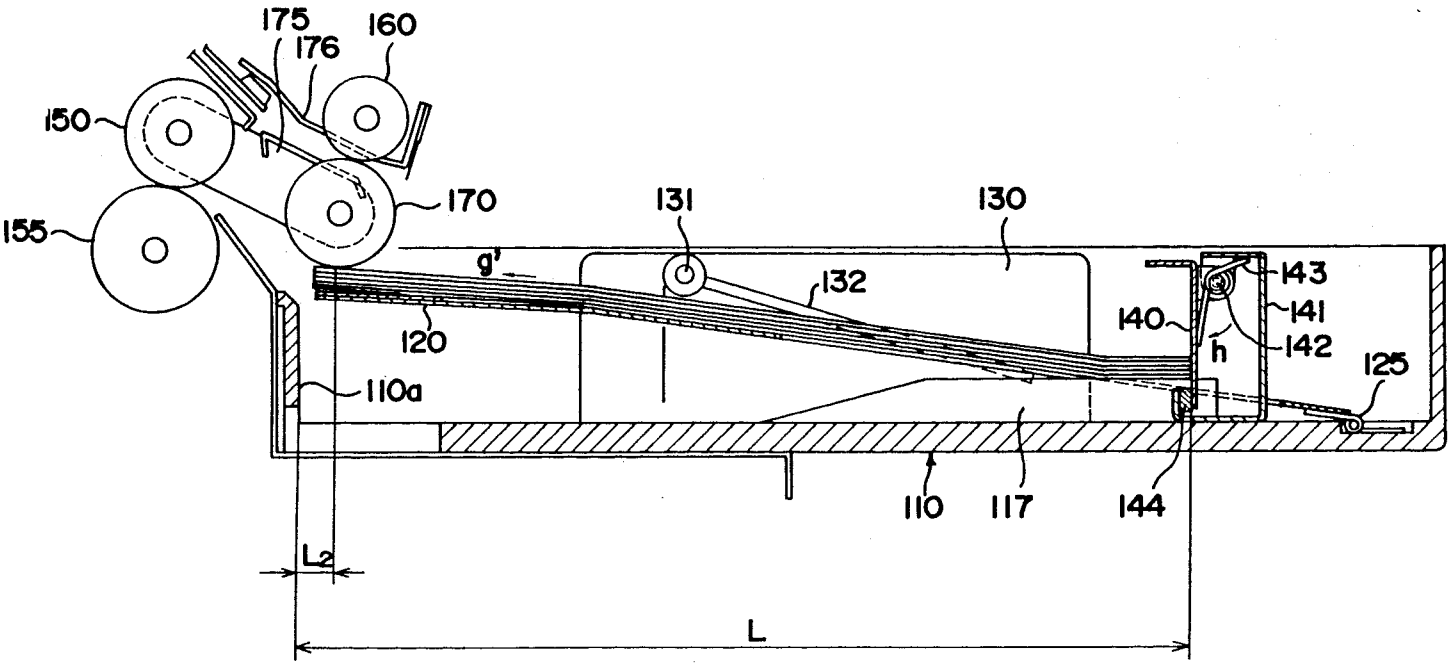

With this embodiment, the drive roller 170 has not only a sheet storing function but also a sheet feeding function. Therefore, as shown in FIG. 15, in feeding a sheet the drive roller 170 is positioned at a distance L2 from the front stopper 110*a* on the cassette 110 so as to touch the leading edge of a sheet elevated through the base plate 120. The distance L from the front stopper 110*a* to the rear stopper 140 is designated to be approximately as long as the length of the sheet. Therefore, as shown in FIG. 13, the distance L1 from the drive roller 170 to the rear stopper 140 is shorter than the distance L. In the case of storing a flexible sheet such as a thin sheet, the sheet itself is looped as soon as the leading edge thereof touches the rear stopper 140, whereby the sheet is successfully stored. On the other hand, in the case of storing a rigid sheet such as cardboard or a sheet provided with rigidness by means of the above-mentioned auxiliary rollers 162 and 172, projection 117, and pressing levers 132, the sheet stops as soon as it passes through the nipping portion between the drive roller 170 and the storing roller 160, whereby it becomes impossible to store the sheet. Therefore, with this embodiment, such a constitution is provided that the rear stopper 140 is supported to pivotally move and is drawn in the sheet feeding direction by a spring.

More specifically, as shown in FIGS. 9 and 13 through 15, the rear stopper 140, which is attached to a holding plate 141 to pivotally move on the pivot 142, is drawn in the direction of an arrow h by a torsion spring 143 wound on the pivot 142, but stops at a position where the bottom of the rear stopper 140 touches a elastic stopper 144 provided on the bottom of the holding plate 141, maintaining distances L and L1.

Figure 14:
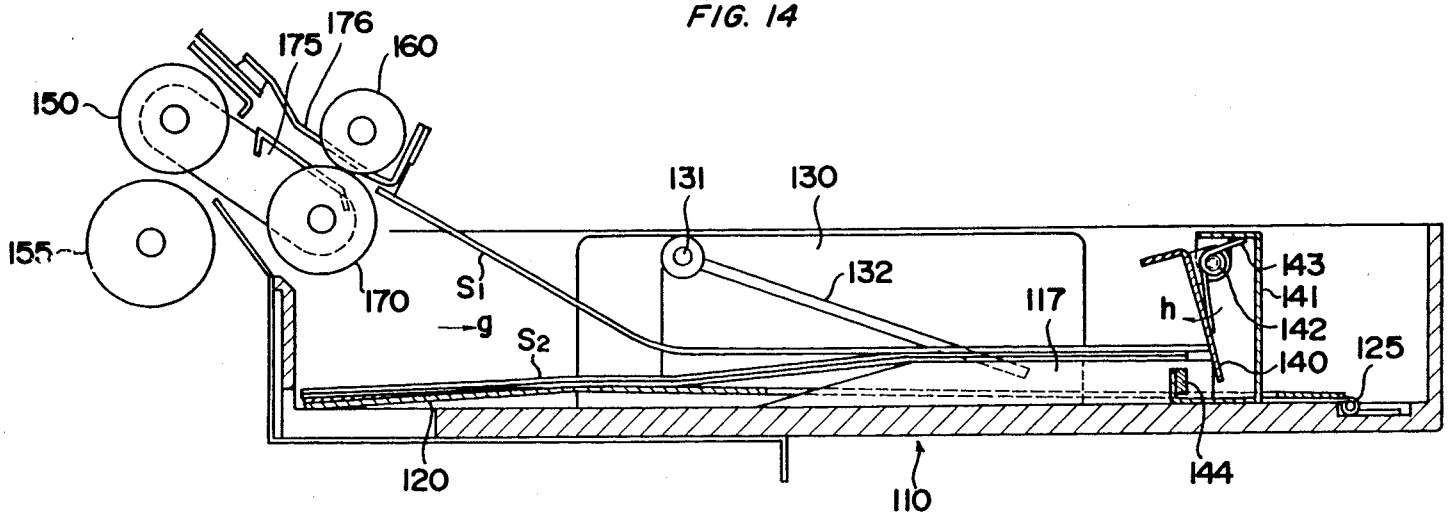

In the case of storing a sheet in the cassette 110, as shown in FIG. 14, as soon as the leading edge of the sheet S1 touches the rear stopper 140, the rear stopper 140 pivotally moves in the direction reverse to an arrow h in order to maintain a longer length for storing the sheet S1 than with the above distance L1. When the trailing edge of the sheet S1 having passed through the rollers 160 and 170 falls onto the base plate 120, the rear stopper 140 pivotally moves in the direction of an arrow h by the drawing power of the torsion spring 143, whereby the sheet S1 is stored and stacked at the same position as that of the sheet S2 having been stored.

Incidentally, a sheet less rigid relative to the sheet storing direction cannot allow the rear stopper 140 to pivotally move against the drawing power of the torsion spring 143. However, with this embodiment, a sheet to be stored into the cassette 110 is provided with rigidness relative to the sheet storing direction by means of the above-mentioned projection 117 and pressing levers 132 on both sides of the cassette 110, thus obtaining sufficient power for pushing the rear stopper 140.

[Touch and separation mechanism of manipulation roller]

As mentioned above, when storing a sheet in the cassette 110, the electromagnetic clutch CL1 is turned ON and the drive roller 170 rotates. At the same time, the feed roller 150 and the manipulation roller 155 rotate together with the drive roller 170. Correspondingly, the wear of rollers 150 and 155 is accelerated, deteriorating the manipulability in feeding a sheet. Further, in storing a sheet, it is not necessary that the rollers 150 and 155 should rotate in contact with each other. Therefore, with this embodiment, the manipulation roller 155 is separated from the feed roller 150 by means of the elevating mechanism 230 for the base plate 120, thereby preventing the acceleration of wear as much as possible.

Figure 16:
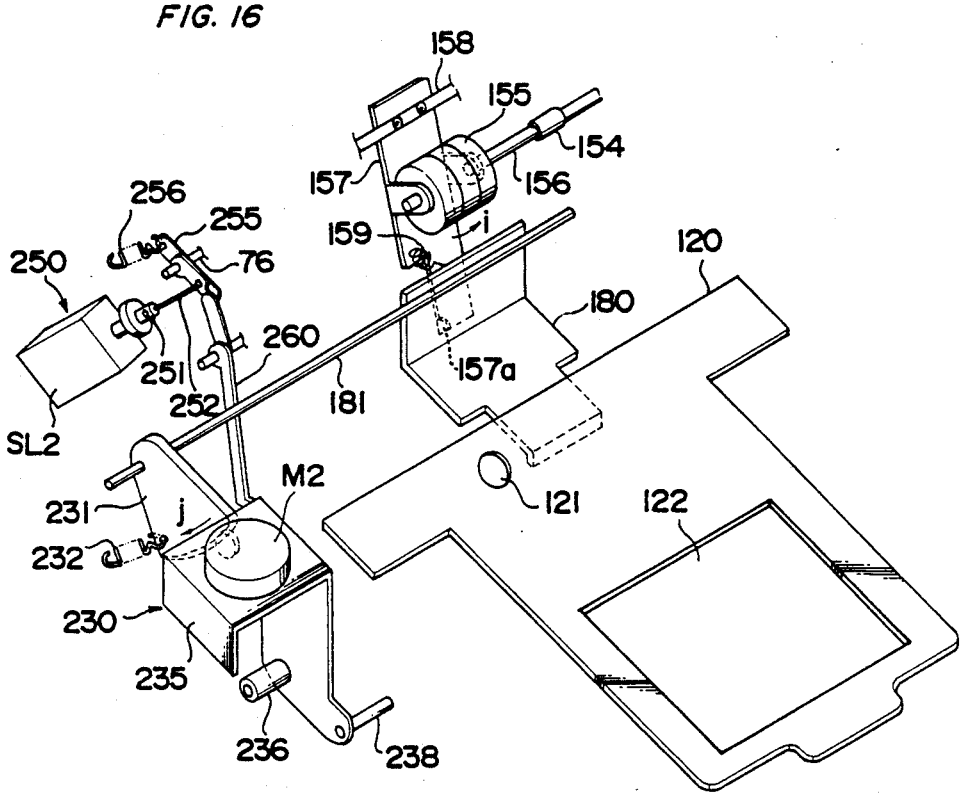

More specifically, as shown in FIGS. 11, 12, and 16, the manipulation roller 155 is mounted on a manipulation frame 157 through the pivot 156. The manipulation frame 157, which can pivotally move on a pivot 158, is attached to the guide plate 98 and drawn in the direction of an arrow i by a extension spring 159. To the lower end of the manipulation frame 157 is attached a projection 157*a* that can contact the back of the elevating plate 180. Therefore, as shown in FIG. 11, when the elevating plate 180 is in a horizontal position when storing a sheet, the manipulation frame 157 of which the projection 157*a* touches the back of the elevating plate 180 is prevented from pivotally moving in the direction of an arrow i, whereby the manipulation roller 155 separates from the feed roller 150. On the other hand, when the elevating plate 180 moves upward because of the elevating mechanism 230 during feeding of a sheet, the restriction on the manipulation frame 157 is canceled, whereby the manipulation roller 155 touches and presses the feed roller 150 through the drawing power of the extension spring 159. (See FIG. 12)

Figure 17:
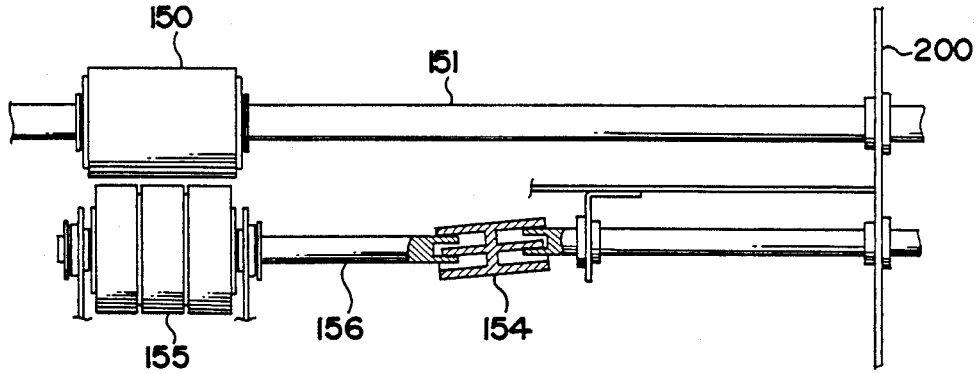

Additionally, as shown in FIG. 17, since the manipulation roller 155 pivotally moves upward and downward as mentioned above, the pivot 156 is divided into two portions, which are combined by means of a flexible joint 154, so as not to interfere with the transmission of rotation power.

[Constitution and operation of elevating and canceling mechanisms]

Figure 18:
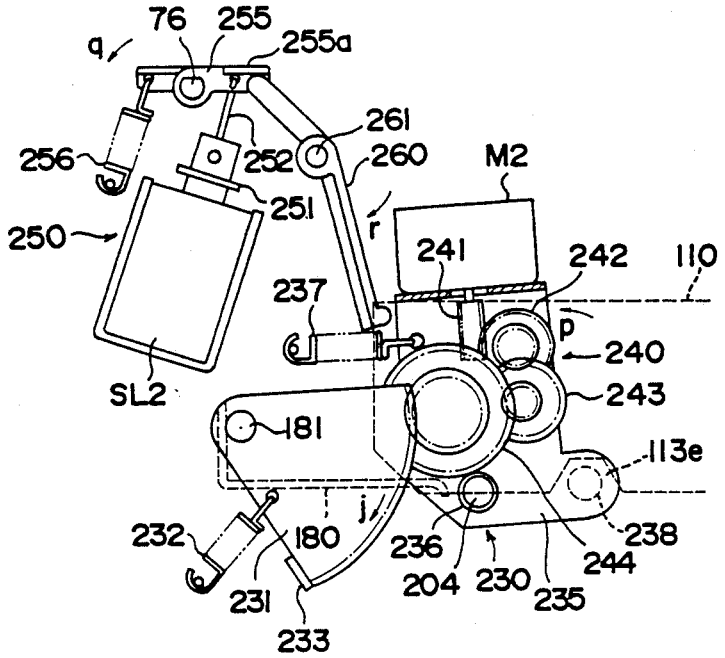

As shown in FIGS. 16 and 18, the mechanism 230 for elevating the base plate 120 comprises the above-mentioned elevating plate 180, a sector gear 231, an adapter plate 235, the motor M2 and a speed-reducing gear mechanism 140. The fan-shaped sector gear 231 having teeth on the peripheral surface thereof is integrally constituted with the elevating plate 180 through a pivot 181 and attracted in the direction of an arrow j by an extension spring 232. However, a side of the sector gear 231 touches a stopper 233, whereby the drawing power is restricted.

The adapter plate 235 can pivotally move on a pivot 204, secured onto the frame 200, by setting the pivot 204 in a tube-shaped bearing 236, and is attracted in the direction of an arrow p. Further, a canceling pin 238 is protruded through an unshown opening into the cassette holder 220 as shown in FIG. 6, and is allowed to be engaged into a notch 113*e* through a slant side 113*c* and a bottom 113*d* on one side of the cassette 110 shown in FIG. 8.

The motor M2 is disposed on the top surface of the adapter plate 235, forming one unit together with the adapter plate 235 and the speed-reducing gear mechanism 240. The speed-reducing gear mechanism 240 comprises speed-reducing gears 242, 243, and 244, and which individually consist of a short-diameter gear portion and a long-diameter gear portion, and the long-diameter gear portion of the first speed-reducing gear 242 is engaged with a worm gear 241 for turning ON the motor M2. The short-diameter gear portion of the final speed-reducing gear 244 is drawn in the direction of an arrow p by a extension spring 237, thereby allowing engagement with the sector gear 231.

On the other hand, a canceling mechanism 250 comprises a solenoid SL2, a lever 255, and a canceling lever 260; and the solenoid SL2 is also used as a switching means for the above-mentioned second switching tongue 75. More specifically, when in the OFF status, a plunger 251 of the solenoid SL2 is protruded out and connected to the lever 255 through a wire 252. The lever 255 is secured to the end of a pivot 76 for the second switching tongue 75 and drawn by a extension spring 256 together with the second switching tongue 75 so as to pivotally move on the pivot 76 in the direction of an arrow q. The canceling lever 260 capable of pivotally moving on a pivot 261 is attracted in the direction of an arrow r due to its own weight. With the canceling lever 260, the top end thereof can touch a projection 255*a* provided on the lever 255 and the bottom end thereof can touch the side of the above mentioned adapter plate 235.

Next, the operations of the elevating mechanism 230 and the canceling mechanism 250, which are constituted as mentioned above, are described as follows.

In the initial state, the solenoid SL2 is in the ON status; the plunger 251 is protruded upward; the lever 255 pivotally moves in the direction of an arrow q; and the second switching tongue 75 is set at the position of the solid line in FIG. 11. Further, the canceling lever 260 pivotally moves in the direction of an arrow r, whereby the bottom end thereof separates from the side of the adapter plate 235. The adapter plate 235 is drawn in the direction of an arrow p by the drawing power of the extension spring 237. As shown in FIG. 18, when the cassette 110 is mounted, the canceling pin 238 engages with the notch 113*e* provided on the cassette 110 and the short-diameter portion of the final speed-reducing gear 244 is engaged with the sector gear 231. In the initial state, the sector gear 231 pivotally moves in the direction of an arrow j and the elevating plate 180 is at an approximate horizontal position. Further, the manipulation frame 157, whose projection 157*a* is pressed by the back of the elevating plate 180, is actuated in the direction reverse to an arrow i, and the manipulation roller 155 separates from the feed roller 150. In order that the elevating plate 180 can actuate the manipulation frame 157 in the direction reverse to an arrow i as mentioned above, the drawing power of the extension spring 232 for the sector gear 231 is designated to be larger than that of the extension spring 159 for the frame 157.

Figure 19:
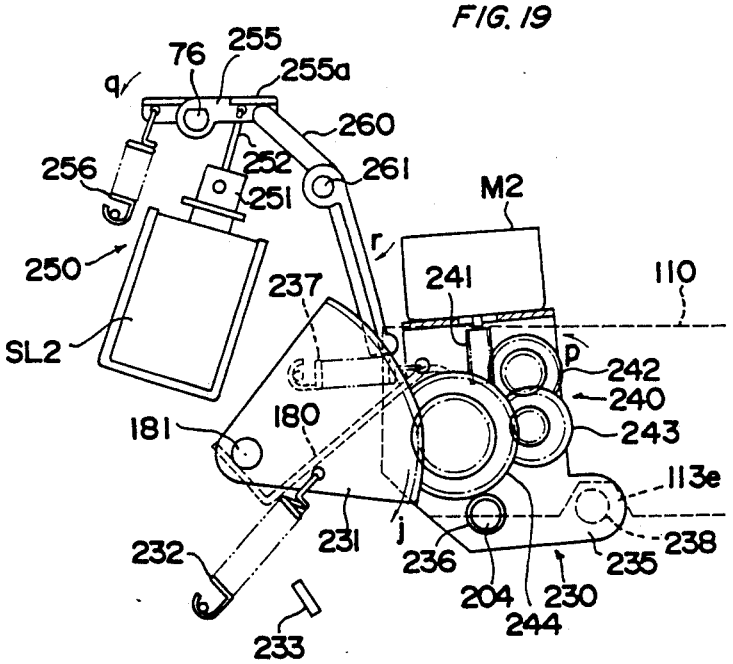

In the duplex copying mode, a sheet having an image on one side thereof is stored in the cassette 110 in a condition shown in FIG. 18. When a elevation signal is provided after having stored in a predetermined number of sheets in the cassette 110, the motor M2 is turned ON, and the rotation power of the motor M2 is transmitted through the speed-reducing gear mechanism 240, whereby, as shown in FIG. 19, the sector gear 231 pivotally moves in the direction reverse to an arrow j. At the same time, the elevating plate 180 also pivotally moves upward, elevating the base plate 120. Following the action of the base plate 120, the manipulation frame 157 pivotally moves in the direction of an arrow i, whereby the manipulation roller 155 touches and presses the feed roller 150. Additionally, the sheets stored on the base plate 120 touch and press the drive roller 170 and the projection 176*a* on the frame 176 releases the optical axis of the sensor SE5, thereby turning OFF the motor M2. Then, the sheets are fed one by one by rotating the drive roller 170 based on a signal for starting the sheet re-feeding operation. The level of the top sheet is always detected by the sensor SE5, and every time the level of the top sheet lowers the motor M2 rotates, allowing the sector gear 231 and the elevating plate 180 to pivotally move upward.

Figure 20:
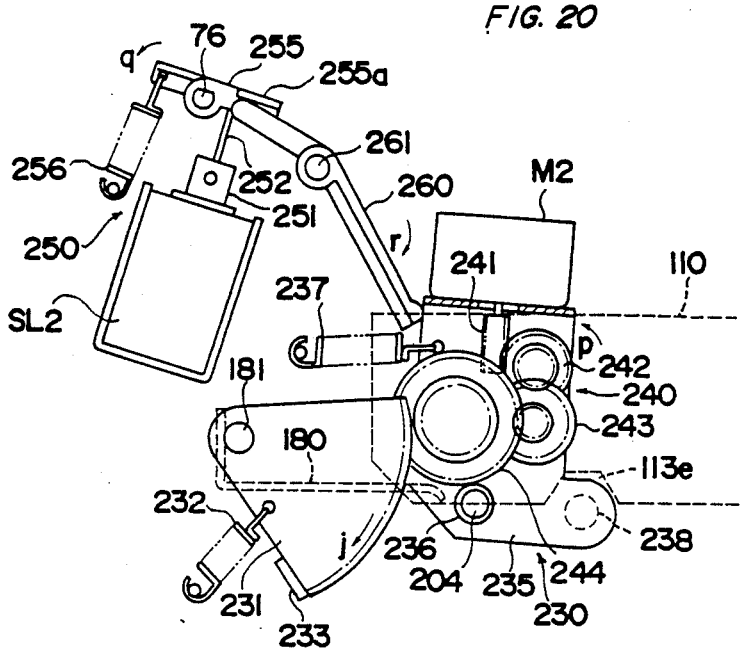

As shown in FIG. 20, when the sensor SE4 detects all the sheets having been fed from the cassette 110, the solenoid SL2 is turned ON and the plunger 251 is drawn back, whereby the lever 255 pivotally moves in the direction reverse to an arrow q against the drawing power of the extension spring 256, allowing the canceling lever 260 to pivotally move in the direction reverse to an arrow r. In this case, the end of the canceling lever 260 presses the side of the adapter plate 235, which pivotally moves on the pivot 204 in the direction reverse to an arrow p against the drawing power of the tension spring 237. Further, the short-diameter gear portion of the speed-reducing fear 244 separates from the sector gear 231, and the sector gear 231 pivotally moves in the direction of an arrow j by the drawing power of the extension spring 232 until touching the stopper 233. At the same time, the elevating plate 180 pivotally moves downward, whereby elevating of the base plate 120 is canceled.

Figure 21:
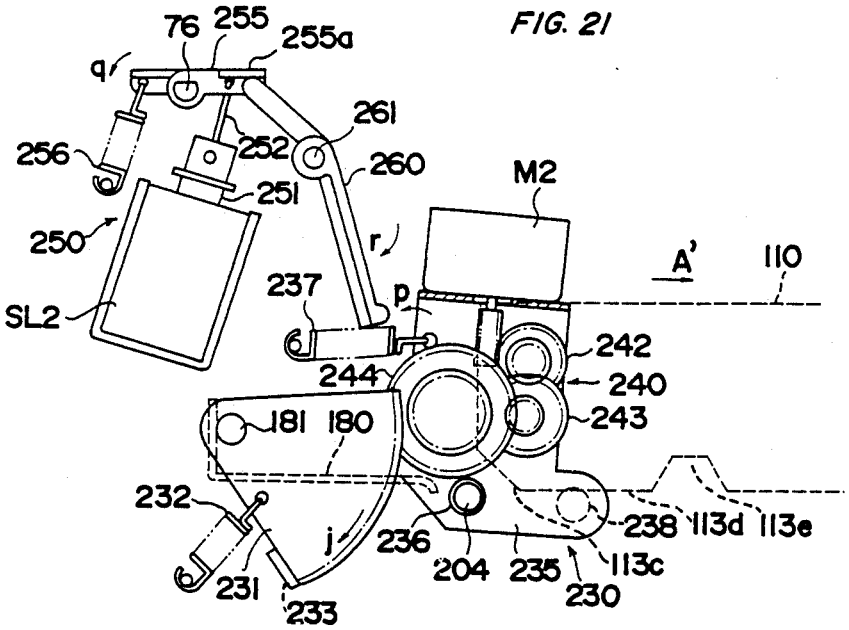

On the other hand, elevating the base plate 120 is also canceled by the attachment or detachment of the cassette 110. As shown in FIG. 21, when the cassette 110 is drawn out in the direction of an arrow A', the bottom 113*d* of the cassette 110 presses down the canceling pin 238, and the adapter plate 235 pivotally moves on the pivot 204 in the direction reverse to an arrow p, allowing the short-diameter gear portion of the speed-reducing gear 244 to separate from the sector gear 231. In attaching the cassette 110, the pin 238 is guided through the slant side 113*c* of the cassette 110 and pressed by the bottom 113*d* of the cassette 110, whereby elevating is also canceled.

Incidentally, elevating of the base plate 120 is canceled by turning ON the solenoid SL2 both when feeding of all sheets has been completed and when sheet jamming is caused in the cassette 110.

[Removal procedures for sheet jamming]

The procedures for removing sheet jamming caused in the duplex and composite copying unit 70 are described as follows.

When sheet jamming occurs in the sheet re-feeding apparatus 100, jammed sheet is removed by drawing out the cassette 110. More specifically, when the cassette 110 is drawn out, the elevating plate 180 returns to the lower position as mentioned above. Following the above action of the elevating plate 180, the manipulation frame 157 pivotally moves in the direction reverse to an arrow i, and the manipulation roller 155 separates from the feed roller 150, allowing jammed sheet to be readily removed from between the rollers 150 and 155.

Additionally, as shown in FIG. 2, when sheet jamming is caused around the transporting rollers 85 and 86, in order to release the sheet transport path, the unit 70 slides along an unshown rail in the direction of an arrow c and the guide plate 91 pivotally moves on a pivot 92 in the direction of an arrow s, whereby jammed sheet is removed.

[Control panel]

Figure 25:
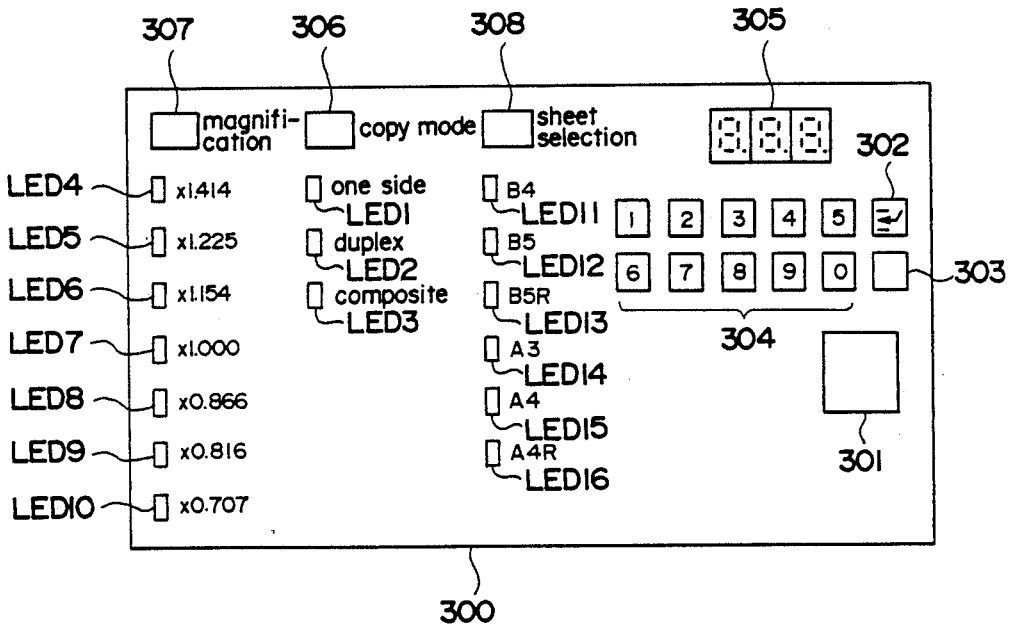

A control panel shown in FIG. 25 is disposed at the front side on the top surface of the copying apparatus 1, and includes a print key 301 for starting a copying operation, an interrupt key 302 for discontinuing a continuous copying operation, a clear/stop key 303 for stopping a copying operation or canceling a predetermined number, ten numerical keys 304 corresponding to the ten numerals of 0, 1, 2, . . . , 9, a display 305 for displaying the predetermined number of copies and the status of the copying apparatus 1, a copy-mode designating key 306, a magnification designating key 307, and a key 308 for designating the sheet size to be fed. Anytime one of these designating keys is turned ON, any of indicators LED1 through LED3, LED4 through LED10, or LED11 through LED16, which are correspondingly disposed below these designating keys, is turned on and off in order to indicate a designated mode. For example, anytime the copy-mode designating key 306 is turned ON, any one of one-side copying mode, duplex copying mode, or composite copying mode is sequentially designated in this order, correspondingly turning on and off any of LED1 through LED3.

[Control circuit]

Figure 26:
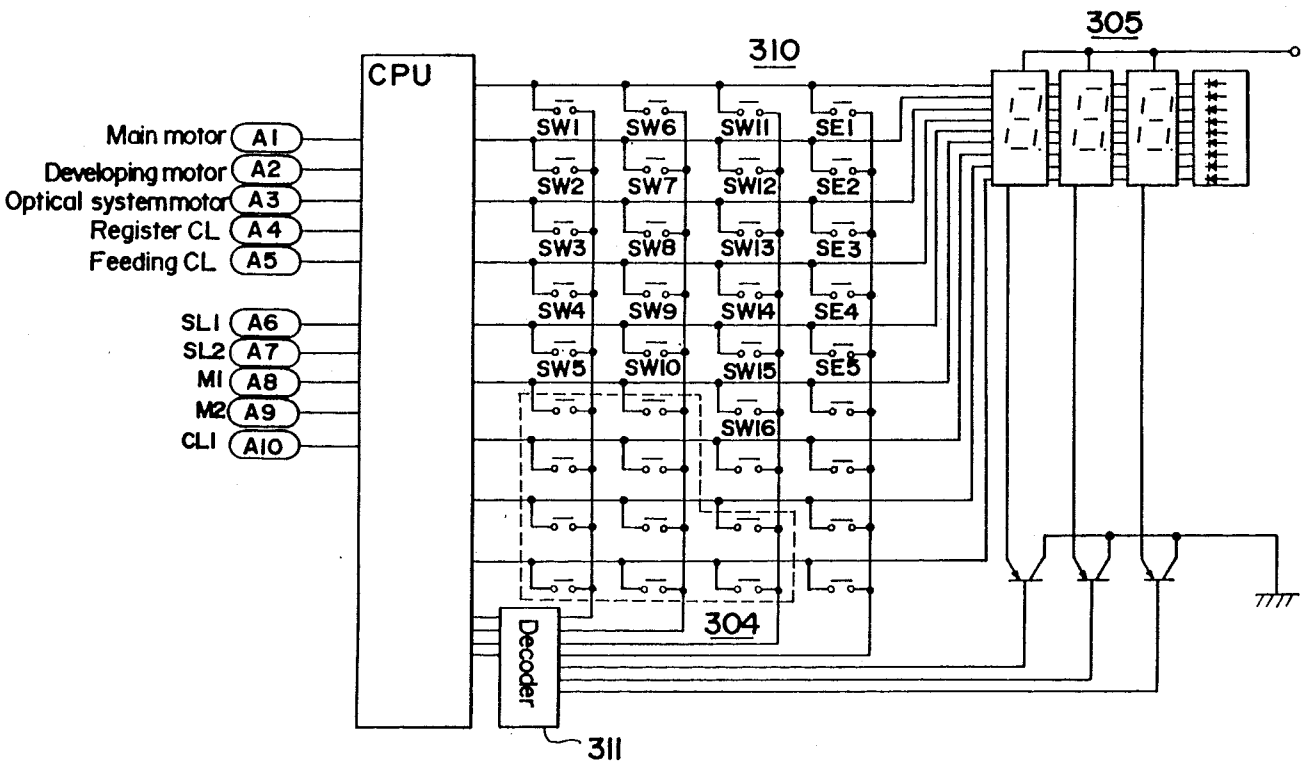

FIG. 26 is a diagram showing a control circuit, wherein a switch matrix 310 is connected to a microcomputer CPU, which is the center of control and the display 305 is connected to the CPU through the matrix 310 and a decoder 311. Additionally, to the output terminals of the CPU are connected the main motor for the copying apparatus 1, the solenoid SL1 for actuating the first switching tongue 71, the solenoid SL2 for actuating the second switching tongue 75, the canceling mechanism 250, and the like.

[Control procedures]

Figure 27:
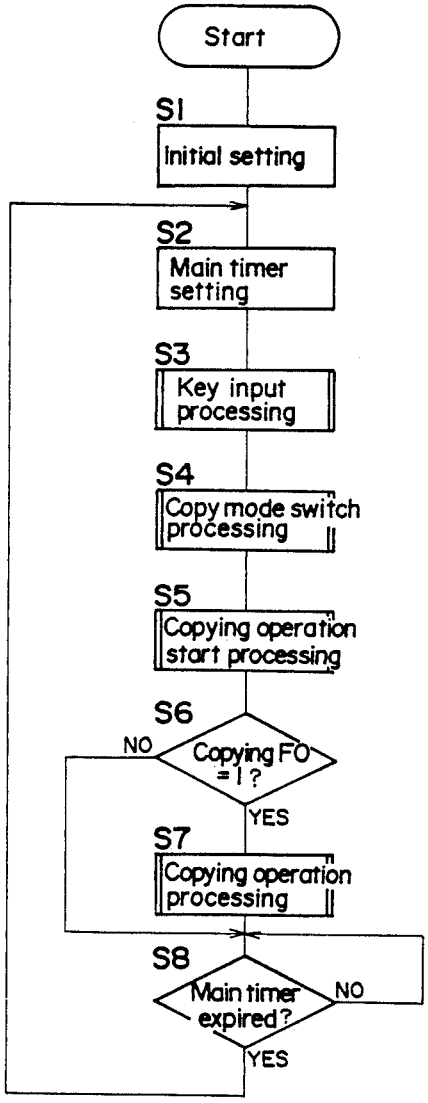

FIG. 27 is a flow chart showing the main routine of the microcomputer CPU.

When the CPU is reset, the program starts. At step S1, the CPU initializes the data-clearance of the random access memory RAM, initializes various resistors, and sets the initial mode for each apparatus.

Incidentally, flags used at the following steps are described hereunder. When at level "0", a copying flag FO indicates that the copying apparatus 1 is not in operation but can accept the next copying operation, and when at level "1", the same flag FO indicates that the copying operation is in progress. When at level "0", a one side copying flag F1 indicates that the one side copying mode has been selected, and when at level "1", the same flag F1 indicates that the duplex copying mode or the composite copying mode has been selected. When at level "0", a duplex copying flag F2 indicating that the duplex copying mode has been selected, and when at level "1", the same flag F2 indicates that the duplex copying mode has been selected.

Next, at step S2, the main timer is set. The main timer counts the time required for the main routine. The count of the main timer is preset by initialization, and the count of timers used in each subroutine is based on that of the main timer.

At step S3, the subroutine for processing key-entered data is executed to process data entered with the various keys on the above-mentioned control panel 300 and to store data, indicating the sizes of sheets loaded in the feeding cassettes 30 and 35, the size of the sheet re-feeding cassette 110, and others.

At step S4, the subroutine for switching the copy mode is executed. This subroutine is described later in detail.

At step S5, the subroutine for copying operation initiation is executed to start the copying operation in conjunction with turning ON the print key 301.

Next, a judgment is made at step S6 as to whether or not the copying flag FO is at level "1". If the judgment is affirmative, that is, the copying operation is in progress, the subroutine for the copying operation is executed at step S7, and step S8 follows. If the judgment is negative at step S6, that is, the copying apparatus is waiting for the next copying operation, and step S8 follows. At step S8, the CPU waits for the count completion of the main timer, and returns to step S2.

Figure 28:
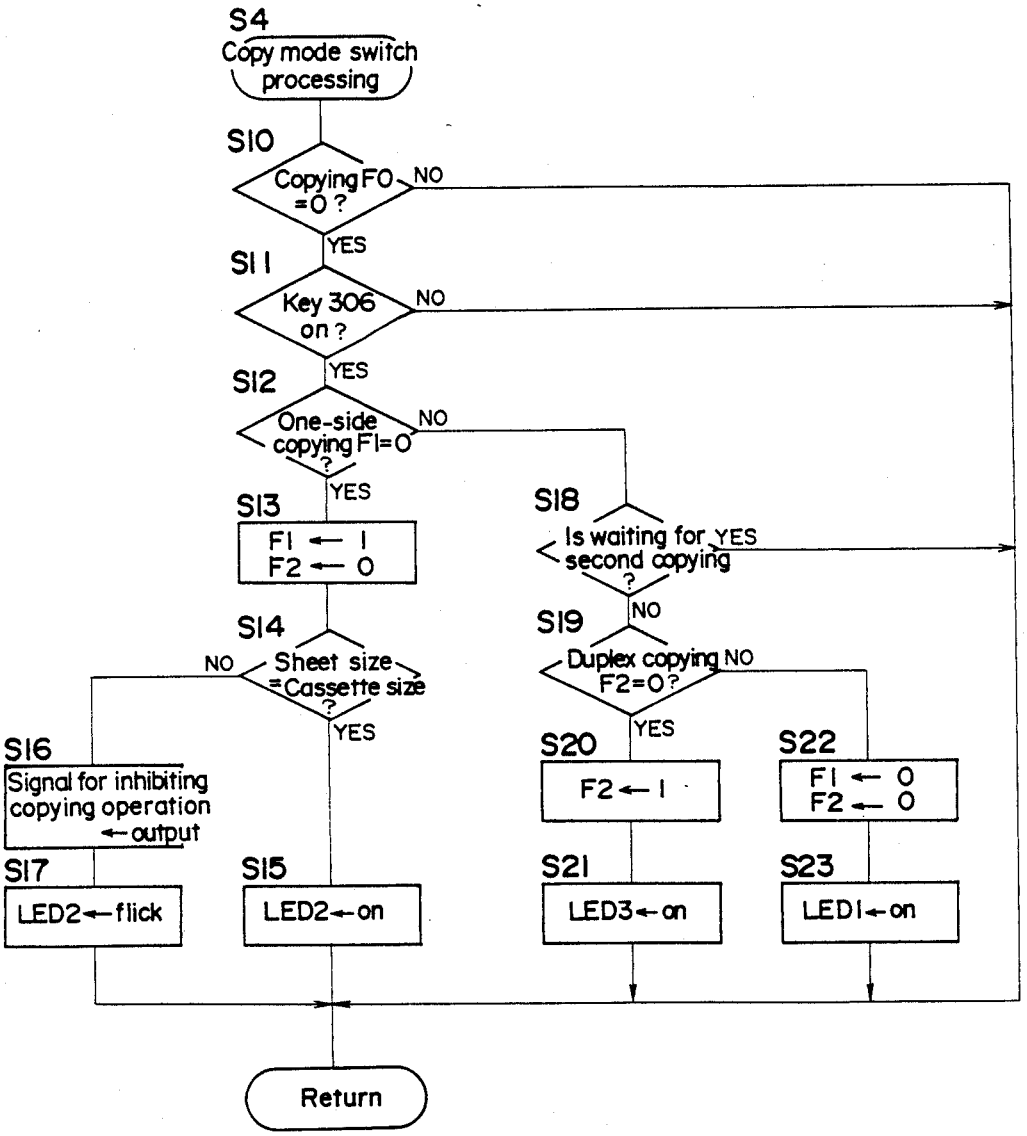

FIG. 28 is a flow chart showing the subroutine for switching the copy mode, which is executed at step S4.

First, a judgment is made at step S10 as to whether or not the copying flag F0 is at level "0". If the judgment is negative, that is, the copying operation is in progress, the subroutine promptly comes to an end. If the judgment is affirmative, that is, the copying apparatus is waiting for the next copying operation, a judgment is made at step S11 as to whether or not the copy-mode designating key 306 is in the ON status. If the judgment is negative, the subroutine promptly comes to an end. If the judgment is affirmative, a judgment is made at step S12 as to whether or not the one-side copying flag F1 is at level "0". If the judgment is affirmative, that is, the normal one-side copying mode is selected, the one-side copying flag F1 is set to "1" and the duplex copying flag F2 is reset to "0" to select the duplex copying mode at step S13.

Next, a judgment is made at step S14 as to whether or not the sheet size selected for the copying operation is the same as the size of the cassette 110 attached to the sheet re-feeding unit 100. If the judgment is affirmative, the duplex copying mode indicator LED2 is turned ON. If the judgment is negative at step S14, that is, the size of the cassette 110 is different from the sheet size selected for the copying operation, a signal for inhibiting the copying operation is output at step S16 and the duplex copying mode indicator LED2 is flicked on at step S17 as a warning.

On the other hand, when the judgment is negative at the above-mentioned step S12, that is, the one-side copying flag F1 is at level "1", a judgment is made at step S18 as to whether or not the copying apparatus 1 is waiting for the second copying operation in the duplex copying mode or in the composite copying mode. If the judgment is affirmative, that is, the copying apparatus 1 is in the waiting status, the subroutine comes to an end. If the judgment is nagative, that is, the copying apparatus 1 is not in a waiting status, a judgment is made at step S19 as to whether or not the duplex copying flag F2 is at level "0". If the judgment is affirmative, that is, the duplex coping mode is selected, the duplex copying flag F2 is set to "1" at step S20 to designate the composite copying mode, and the composite copying mode indicator LED3 is turned ON. If the judgment is negative at step S19, that is, the composite copying mode is selected, the one-side copying flag F1 and the duplex copying flag F2 are reset to "0" at step S22 to designate the one-side copying mode, and the one-side copying mode indicator LED1 is turned ON.

More specifically, when the duplex copying mode is designated, following the above-mentioned procedures, the sheet size selected for the first copying operation is compared with the size of the sheet feeding cassette 110 [step S14]; when the sizes are the same the duplex copying operation is allowed [step S15]; when the sizes are different the copying operation is inhibited and the duplex copying mode indicator LED2 is flicked on as a warning [steps S16 and S17], thereby preventing a difference between the size of the sheets to be fed and the size of the cassette 110 to store sheets from causing sheet jamming in the cassette 110. In this case, if an operator changes the size of the sheets to be fed, or exchanges the cassette for another cassette of the same size as that of sheets to be fed, the duplex copying operation is allowed.

Incidentally, when the size of sheet to be fed differs from the size of the cassette 110, any of the sheet size indicators LED11 through LED16 that indicates the same size as that of the cassette 110 may be flicked on to inform the operator of the available size of sheets to be fed. Or, an arrangement may be provided so as to display a warning to exchange the cassette for another cassette of the same size as that of the sheets to be fed.

In addition, when a plurality of sheet feeding cassettes are disposed to the copying apparatus 1, an arrangement may be provided so as to unconditionally select one of the feeding cassettes 30 and 35 that is loaded with sheets of the same size as the size of the attached sheet feeding cassette 110.

[Other embodiments]

[i] Combination of duplex and composite copying unit

Figure 29:
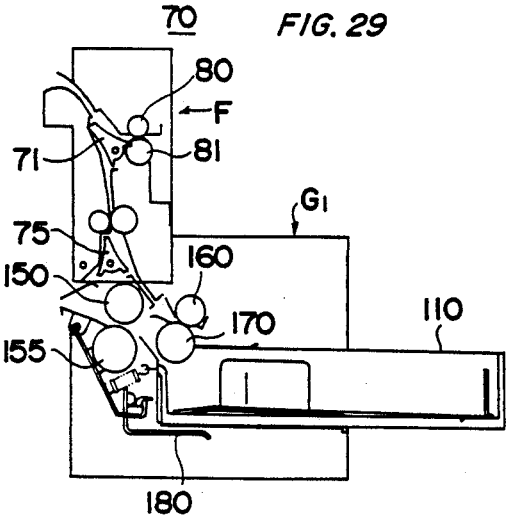
FIGS. 29 through 31 show an embodiment of exchanging a sheet re-feeding block.

As shown in FIG. 29, with the above-mentioned embodiment, the duplex and composite copying unit 70 can be divided into a transport block F and a sheet re-feeding block G1. The transport block F includes the switching tongues 71, 75, and others, and the sheet re-feeding block G1 includes the cassette 110 and others.

Figure 30:
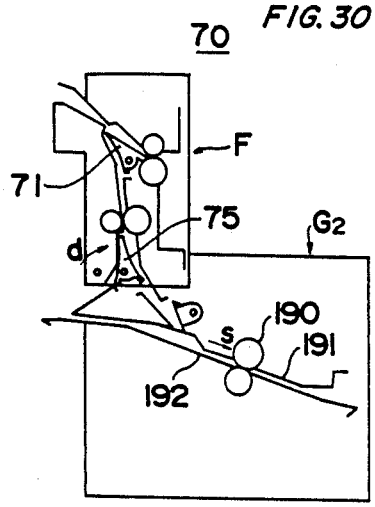

On the other hand, FIG. 30 illustrates the case where, instead of the above sheet re-feeding block G1, another sheet re-feeding block G2, including a pair of rollers 190 for switching back a sheet, guide plates 191 and 192, and others, is attached to the above transport block F. In the duplex copying mode, with the re-feeding block G2, the second switching tongue 75 is set at the position of the solid line in the figure, whereby a sheet is transported through the pair of rollers 190 in the direction of an arrow s, and then fed into the above-mentioned re-fed sheet passing box 60 by the rotation of the pair of rollers 190 in the reverse direction. In the composite copying mode, the second switching tongue 75 pivotally moves in the direction of an arrow d, whereby a sheet is directly fed into the re-fed sheet passing box 60.

Figure 31:
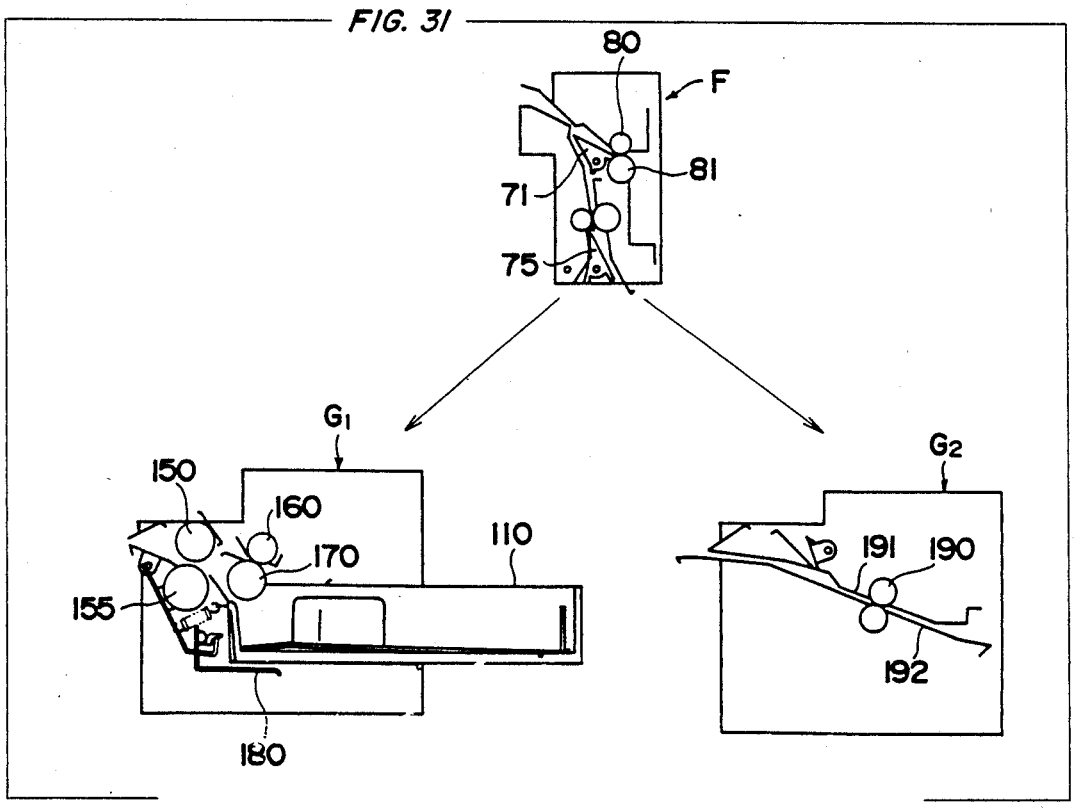

Therefore, as shown in FIG. 31, if the sheet re-feeding blocks G1 and G2 are prepared for each case, the transport block F is allowed to be combined with either of the blocks G1 and G2 in accordance with the requirements of a user.

[ii] Provision of sheet rigidness in sheet storing

As shown in FIG. 10, in order to successfully store a sheet S1, an arrangement is provided so that the sheet S1 is made rigid in the sheet storing direction using the auxiliary rollers 162 and 172, whereby the width of the sheet S1 is shorter than that of a flat sheet.

Figure 32:
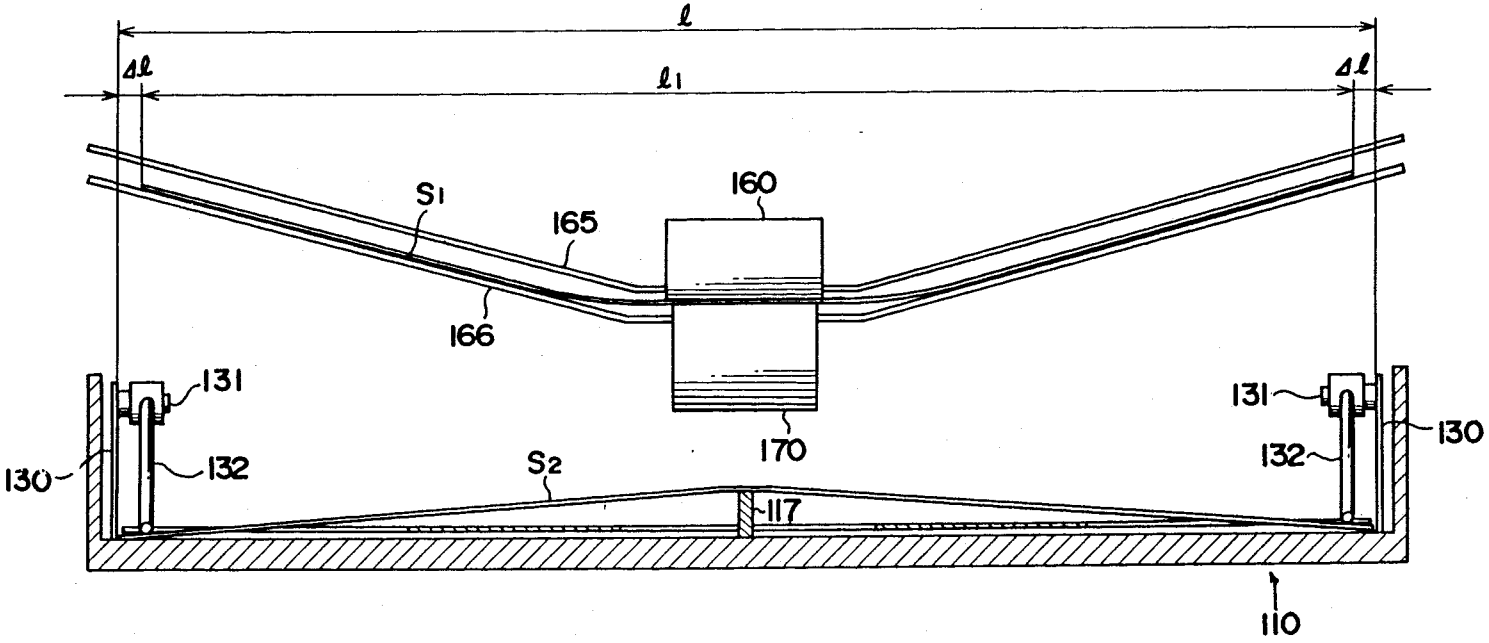
FIG. 32 is a sectional view showing a modified embodiment of a guide portion for storing a sheet to the cassette.

The same effect can be attained by providing an arrangement, wherein as shown in FIG. 32 guide plates 165 and 166 are correspondingly disposed on both sides of the sheet storing rollers 160 and the drive roller 170 so as to have a sheet S1 pass through these plates.

[iii] Elevating mechanism

Figure 33:
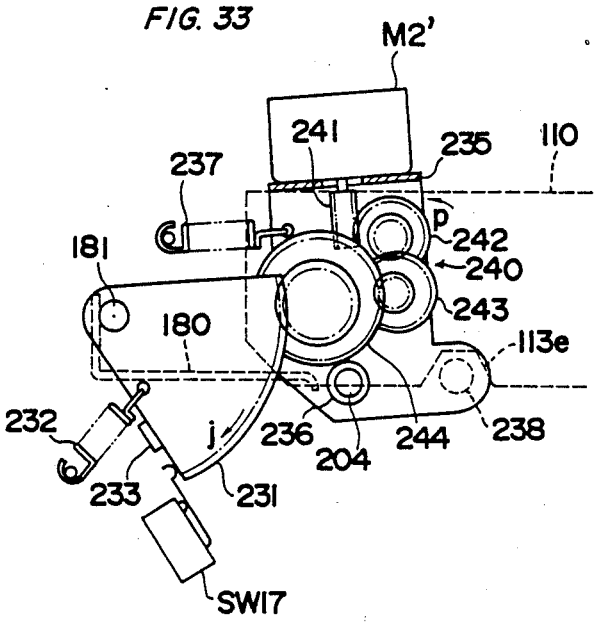
FIGS. 33 through 35 are front views showing modified embodiment of the elevating mechanism for each operative position.
Figure 34:
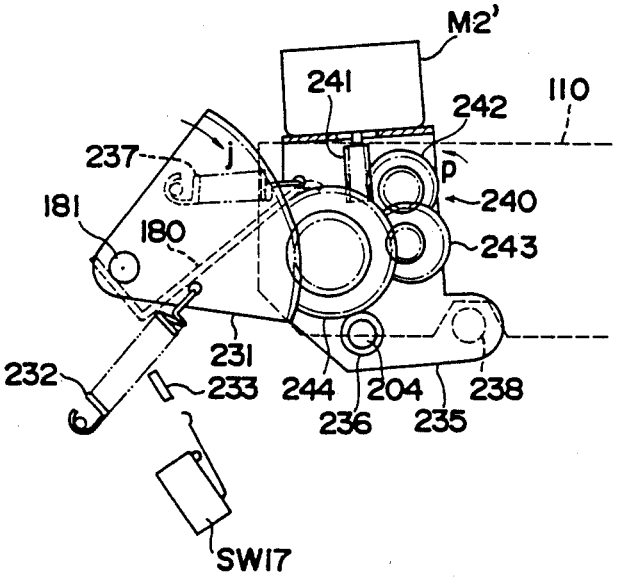
Figure 35:
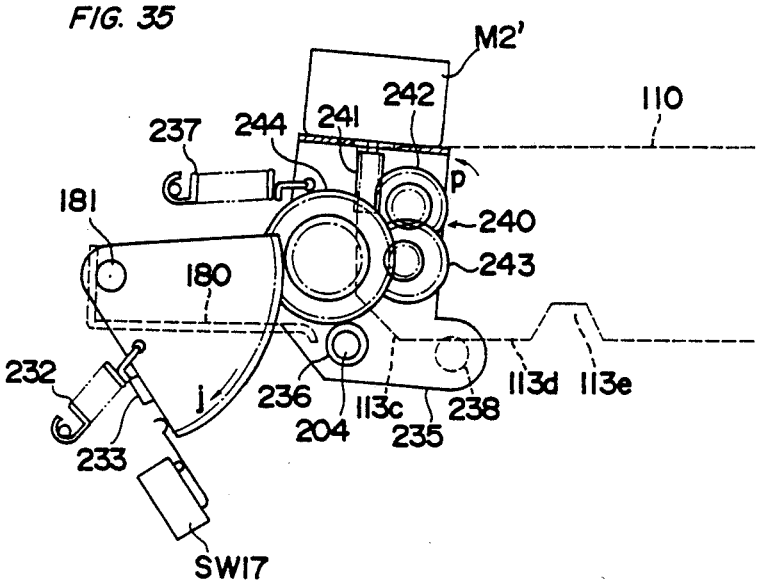
Figure 36:
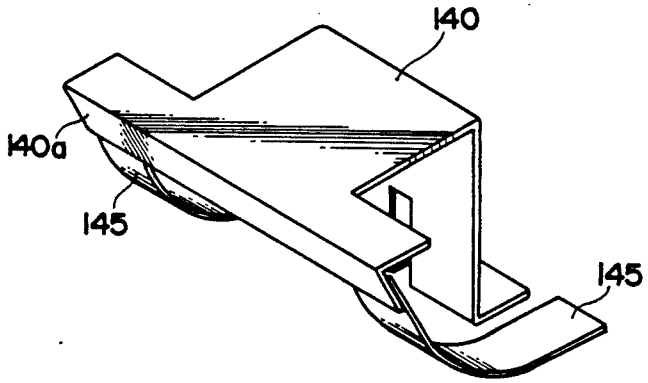
FIGS. 36 through 39 show a modified embodiment of the cassette.
Figure 37:
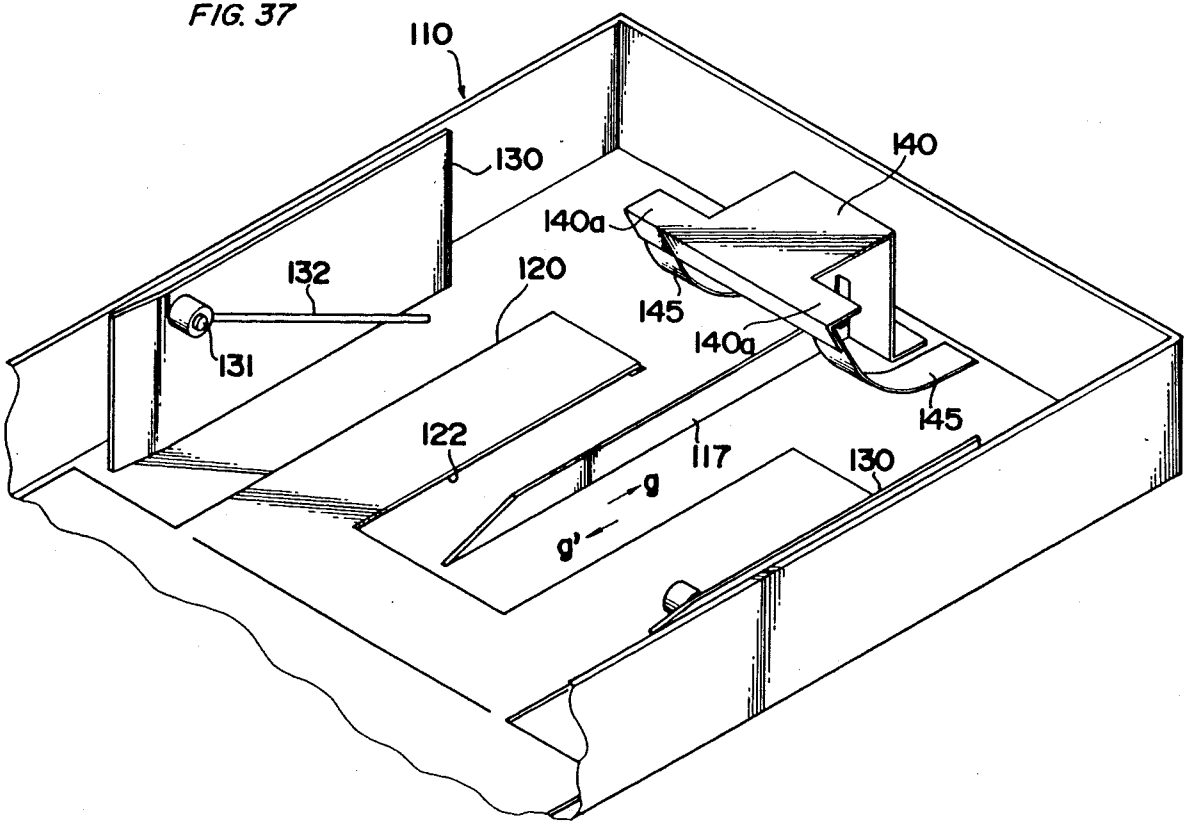
Figure 38:
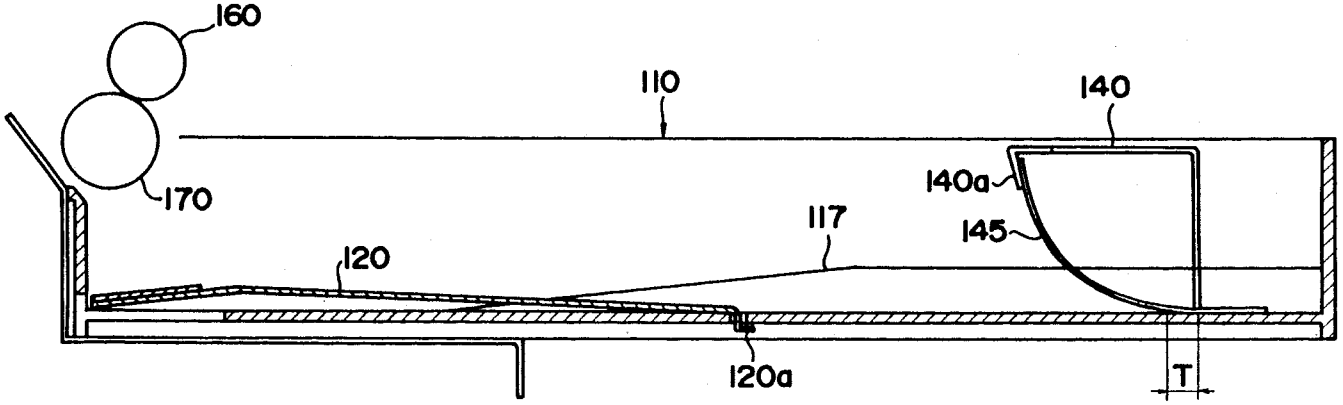

FIGS. 33, 34, and 35 are schematic diagrams showing a modified embodiment of the mechanism for elevating the base plate 120, wherein elevation of the base plate 120 by the elevating plate 180 can be canceled without employing the above-mentioned canceling mechanism 250. Incidentally, in each figure, if an element is the same as with the above-mentioned embodiment, it will have the same number as the embodiment.

More specifically, with this embodiment a motor M2′ for elevation, which can rotate in the forward and reverse directions, is employed to directly allow the sector gear 231 to pivotally move up and down, and a microswitch SW17 detects the sector gear 231 having been drawn back.

In order to elevate sheets, the motor M2′ rotates in the forward direction, thereby allowing the elevating plate 180 to pivotally move in the direction reverse to an arrow j together with the sector gear 231. The rotation of the motor M2′ in the forward direction is then stopped in accordance with a signal from the above-mentioned sheet-level detecting sensor SE5. In order to cancel elevation of sheets, the motor M2′ rotates in the reverse direction, thereby allowing the sector gear 231 and the elevating plate 180 to pivotally move in the direction of an arrow j. Then, the rotation of the motor M2′ in the reverse direction is stopped in accordance with a signal indicating that the switch SW17 detects the sector gear 231 having been drawn back at a lower position.

Incidentally, also with this modified embodiment, when the cassette 110 is attached or detached, the pin 238 of the adapter plate 235 engages with the bottom 113*d* of the cassette 110, and the adapter plate 235 pivotally moves on the pivot 204 in the direction reverse to an arrow p, whereby elevation of sheets is canceled. Additionally, also with this embodiment, as in the above-mentioned embodiment, the manipulation roller 155 touches and separates from the feed roller 150 following elevation of sheets and canceling of elevation

[iv] Rear stopper portion

FIGS. 36 through 39 are a schematic diagram showing a modified embodiment of the rear stopper portion of the cassette 110. With this embodiment, the rear stopper 140 is secured with a screw or others at a position predetermined in accordance with the length of a sheet, and to each arm portion 140*a* of the stopper 140 is attached one end of a flexible pressing plate 145. The pressing plate 145 hangs down in the cassette 110, forming a circular arc, and touches the bottom of the cassette 110.

Figure 39:
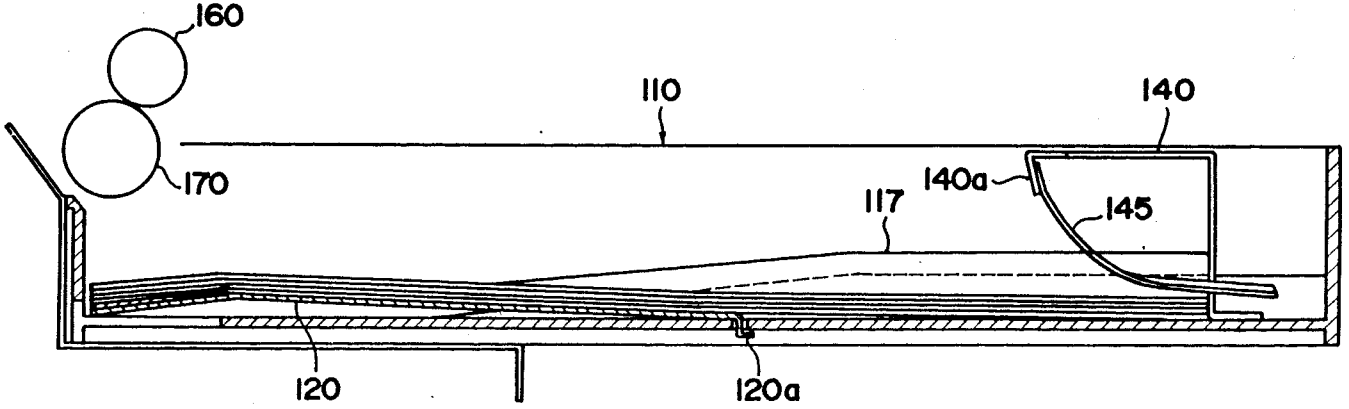

When storing a sheet, the leading edge of the sheet touches the middle portion of the pressing plate 145 and is guided so as to slip under the portions T where the pressing plate 145 and the cassette 110 are in contact with each other. Then, the leading edge of the sheet touches the rear stopper 140, whereby the sheet is regulated at a predetermined position. In addition, every time the number of sheets stored in the cassette 110 increases, the pressing plate 145 is elevated upward little by little as shown in FIG. 39.

More specifically, by pressing down the leading edge of a stored sheet, the pressing plate 145 corrects the sheet curled due to heat, thereby allowing the rear stopper 140 to precisely regulate the sheet at the sheet storing position. Further, the pressing plate 145 is attached to the rear stopper 140, which is secured at a position predetermined in accordance with the size of sheets. Therefore, it is not required to determine a specific position for the attachment of the pressing plate 145 in accordance with each sheet size.

[v] Sheet feeding cassette

Figure 40:
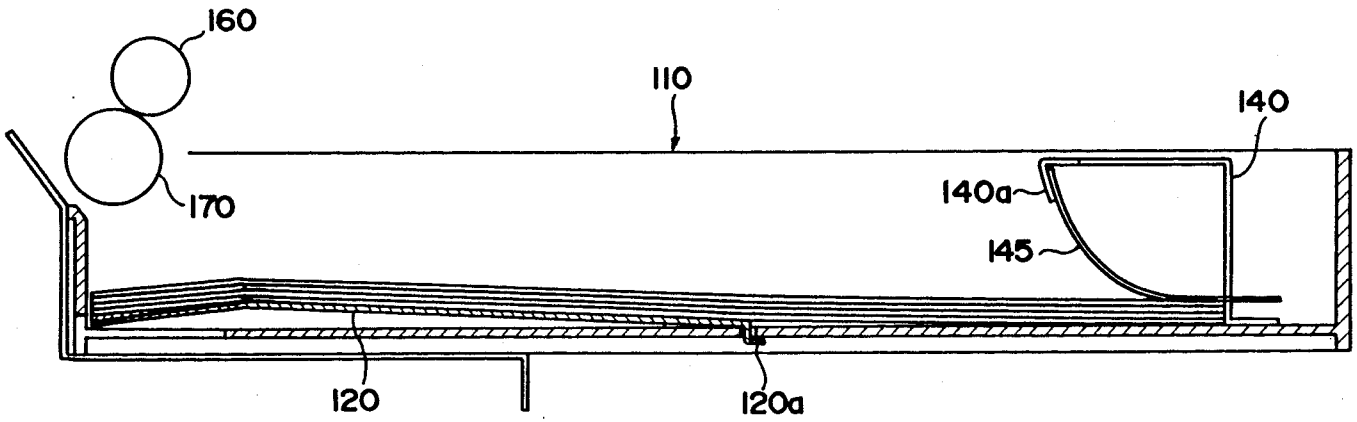
FIG. 40 is a longitudinal sectional view showing another modified embodiment of the cassette.

FIG. 40 is a schematic diagram showing another modified embodiment of the cassette 110. With this embodiment, the projection 117 in the middle of the cassette 110 and the pressing levers 132 on the side stoppers have both been eliminated. In this case, instead of two pressing plates 145, only one pressing plate 145 may be disposed on the middle portion of the rear stopper 140.

Additionally, the rear stopper 140 may unconditionally move to a position predetermined in accordance with each sheet size.

Although the present invention has described in connection with the preferred embodiment thereof, it is to be noted that various changes and modifications are apparent to those skilled in the art. Such changes and modifications are to be understood as included within the scope of the present invention as defined by the appended claims, unless they depart therefrom.

What is claimed is:

1. A sheet re-feeding apparatus for once storing a sheet already having an image formed thereon with an image forming apparatus and then re-feeding the sheet to the image forming apparatus, comprising:

a cassette for stacking and storing the sheets having images formed thereon, which cassette is detachable from a main body of the sheet re-feeding apparatus, wherein the size of the cassette corresponds to the size of the sheets to be stored in said cassette;

transporting means for transporting the sheets having images formed thereon from said image forming apparatus to said cassette;

sheet feeding means for feeding the sheets which have been stored in said cassette one by one to said image forming apparatus; and sheet-size detecting means for detecting the size of the sheets to be stored in said cassette.

2. A sheet-re-feeding apparatus claimed in claim 1, wherein said cassette has a pair of stoppers for regulating both side edges of a sheet, which stoppers are provided at a position predetermined in accordance with the width of sheets to be stored.

3. A sheet re-feeding apparatus for once storing sheets having images formed thereon with an image forming apparatus and then re-feeding the sheets to the image forming apparatus, comprising:

a cassette receiving section for receiving a cassette, which cassette was selected from a plurality of cassettes so as to store the sheets having images formed thereon in accordance with the size of the sheets;

sheet storing means for transporting the sheets having images formed thereon from said image forming apparatus to said cassette received in said cassette receiving section and storing the sheets therein;

sheet feeding means for feeding the sheets which have been stored in said cassette one by one to said image forming apparatus through said cassette receiving section; and detecting means for detecting the size of the cassette received in said cassette receiving section.

4. A sheet re-feeding apparatus for once storing sheets having images formed with an image forming apparatus and then re-feeding the sheets to the image forming apparatus, comprising:

sheet storing means for storing the sheets having images formed thereon, which includes a pair of stoppers separated by a space approximately equal to the width of the sheet, and said stoppers regulate both of the lateral side edges of the sheet;

transporting means for transporting the sheets having images formed thereon from the image forming apparatus to said sheet storing means in a condition where the sheet is curved widthwise; and sheet feeding means for feeding the sheets which have been stored in said sheet storing means one by one to said image forming apparatus.

5. A sheet re-feeding apparatus claimed in claim 4, wherein said transporting means comprises at least one pair of rollers which are arranged apart from each other in the widthwise direction of a sheet and slightly overlapping each other in the vertical direction.

6. A sheet re-feeding apparatus claimed in claim 4, wherein said transporting means comprises at least one pair of rollers disposed in the middle portion relative to the widthwise direction of the sheet and capable of catching and transporting sheets, as well as a sheet transporting path comprising a pair of guide plates curved in the widthwise direction of the sheet.

7. A sheet re-feeding apparatus for once storing sheets having images formed with an image forming apparatus and then re-feeding the sheets to the image forming apparatus, comprising:

sheet storing means for storing the sheets having images formed thereon, said sheet storing means having a protruding middle portion which is higher than a side portion, whereby the sheets are stacked in a condition where the sheets are curved widthwise on the sheet storing means;

transporting means for transporting the sheets having images formed thereon from said image forming apparatus to said sheet storing means; and sheet feeding means for feeding the sheets which have been stored in said sheet storing means one by one to said image forming apparatus.

8. A sheet re-feeding apparatus for once storing sheets having images formed with an image forming apparatus and then re-feeding the sheets to the image forming apparatus, comprising:

sheet storing means for stacking and storing the sheets having images formed thereon in a condition where the sheets are curved widthwise;

transporting means for transporting the sheets having images formed thereon from said image forming apparatus to said sheet storing means; and sheet feeding means for feeding the sheets which have been stored in said sheet storing means one by one to said image forming apparatus;

wherein said sheet storing means comprises:

a sheet stacking surface for stacking the sheets thereon;

a projection which is provided at the middle of said sheet stacking surface and extends in the sheet feeding direction of the sheet feeding means;

a pair of stoppers for regulating both side edges of the sheets stacked on said sheet stacking surface; and pressing means for pressing both side portions of the sheets stacked on said sheet stacking surface.

9. A sheet re-feeding apparatus claimed in claim 8, wherein said pressing means comprises levers disposed on said side stoppers so as to pivotally move in the vertical direction and to actuate in the sheet pressing direction.

10. A sheet re-feeding apparatus for once storing sheets having images formed with an image forming apparatus and then re-feeding the sheets to the image forming apparatus, comprising:

sheet storing means for stacking and storing the sheets having images formed thereon;

transporting means for transporting the sheets having images formed thereon from said image forming apparatus to said sheet storing means;

sheet feeding means for feeding the sheets which have been stored in said sheet storing means one by one to said image forming apparatus;

regulating means provided on said sheet storing means and capable of moving back and forward relative to the sheet transporting direction, which can contact and regulate the leading edge of the sheet transported by said transportation means;

means for urging said regulating means in the direction reverse to the sheet transporting direction; and means for preventing said regulating means from moving in the direction reverse to the sheet transporting direction in order to keep it at a specific position.

11. A sheet re-feeding apparatus claimed in claim 10, wherein said regulating means is a plate supported so as to pivotally move and said urging means is a spring provided at the center of the pivotal movement of said plate.

12. A sheet re-feeding apparatus for once storing sheets having images formed with an image forming apparatus and then re-feeding the sheets to the image forming apparatus, comprising:

sheet storing means for stacking and storing the sheets having images formed thereon on a sheet stacking surface;

transporting means for transporting the sheets having images formed thereon from said image forming apparatus to said sheet storing means;

sheet feeding means for feeding the sheets which have been stored in said sheet storing means one by one to said image forming apparatus; and pressing means provided on said sheet storing means, which touches the leading edge of the sheet transported by said transporting means, whereby said leading edge of the sheet stacking surface and pressed on said sheet stacking surface after having been stored.

13. A sheet re-feeding apparatus claimed in claim 12, wherein said pressing means has an arched flexible member comprising;

a nipping portion for nipping the leading edge of the sheet transported by said transporting means together with said sheet stacking surface; and a guiding portion which is in contact with the leading edge of the sheet transported by said transporting means, whereby said leading edge of the sheet is guided to said nipping portion.

14. A sheet re-feeding apparatus for once storing sheets having images formed with an image forming apparatus and then re-feeding the sheets to the image forming apparatus, comprising:

sheet storing means for stacking and storing the sheets having images formed thereon:

a drive roller disposed above said sheet storing means and capable of moving up and down;

positioning means for setting said drive roller at a specific lower position; and sheet elevating means for elevating the sheets stored in said sheet storing means, whereby said drive roller is allowed to touch the top sheet due to its weight;

wherein said drive roller at said specific lower position transports the sheets having images formed with said image forming apparatus to said sheet storing means, and feeds the sheets one by one from said sheet storing means to said image forming apparatus when touching the top sheet due to its weight.

15. A sheet re-feeding apparatus claimed in claim 14, wherein said drive roller is attached to one end of an arm capable of pivotally moving.

16. A sheet re-feeding apparatus claimed in claim 15, wherein said sheet storing means comprises an elevating plate capable of pivotally moving, on which the sheets are stacked and stored and which is allowed to pivotally move by said sheet elevating means.

17. A sheet re-feeding apparatus for once storing sheets having images formed with an image forming apparatus and then re-feeding the sheets to the image forming apparatus, comprising:

sheet storing means for stacking and storing the sheets having images formed thereon; and sheet storing/feeding means capable of storing the sheets in said sheet storing means and feeding the sheets from said sheet storing means to said image forming apparatus, which comprises:

a drive roller disposed above said sheet storing means and in the middle portion relative to the sheet widthwise direction, which moves up and down between the sheet feeding position where said drive roller contacts the top sheet and the storing position where said drive roller separates from said top sheet;

auxiliary rollers disposed on the same pivot as said drive roller, which move up and down together with said drive roller and whose diameter is smaller than that of said drive roller; and storing rollers disposed above said drive roller and said auxiliary rollers, which store the sheets to said sheet storing means in conjunction with said drive roller and said auxiliary rollers.

18. A sheet re-feeding apparatus claimed in claim 17, wherein said storing rollers are arranged apart from said drive roller and said auxiliary rollers in the widthwise direction of the sheet and overlapping said auxiliary rollers in the vertical direction.

* * * * *